US008690287B2

(12) United States Patent
Yamauchi et al.

(10) Patent No.: US 8,690,287 B2
(45) Date of Patent: Apr. 8, 2014

(54) PRINTER AND MEDIUM FOR STORING PRINTING CONTROL PROGRAM

(75) Inventors: Junichi Yamauchi, Yokohama (JP); Daisuke Tanaka, Shinagawa (JP)

(73) Assignee: Fujitsu Limited, Kawasaki (JP)

( * ) Notice: Subject to any disclaimer, the term of this patent is extended or adjusted under 35 U.S.C. 154(b) by 106 days.

(21) Appl. No.: 13/535,113

(22) Filed: Jun. 27, 2012

(65) Prior Publication Data

US 2013/0076821 A1 Mar. 28, 2013

(30) Foreign Application Priority Data

Sep. 22, 2011 (JP) ..... 2011-206780

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 7,192,127 | B2 * | 3/2007 | Kudo et al. | 347/86 |
| 7,556,366 | B2 * | 7/2009 | Kudo et al. | 347/86 |
| 7,708,390 | B2 * | 5/2010 | Ogawa et al. | 347/71 |

FOREIGN PATENT DOCUMENTS

| | | |
|---|---|---|
| JP | 05-028650 U | 4/1993 |
| JP | 08-207381 A | 8/1996 |

* cited by examiner

*Primary Examiner* — Lamson Nguyen
(74) *Attorney, Agent, or Firm* — Maschoff Brennan

(57) ABSTRACT

A printer includes a memory that memorizes a value of a maximum stroke and a processor that executes a process. The process includes calculating a maximum stroke time that lasts from when a print pin arranged in a printhead is projected from the printhead by the maximum stroke to when the print pin is retracted in the printhead, setting an adjustment printing area on the printing medium, and switching a movement timing of the printhead in accordance with the maximum stroke time when a printing position of the printhead falls within the adjustment printing area set on the printing medium.

14 Claims, 26 Drawing Sheets

PRINTER AND MEDIUM FOR STORING PRINTING CONTROL PROGRAM

CROSS-REFERENCE TO RELATED APPLICATION

This application is based upon and claims the benefit of priority of the prior Japanese Patent Application No. 2011-206780, filed on Sep. 22, 2011, the entire contents of which are incorporated herein by reference.

FIELD

The embodiments discussed herein are related to a printer having a printhead including a head pin.

BACKGROUND

A serial printer is known as one type of printers having a head pin. The serial printer prints with the head pin kept in contact with a paper sheet. The serial printer prints with the printhead placed at a specific printing position while the printhead performs a first scan on the printing medium. Techniques of controlling damage on the head pin, such as breaking of the head pin, during printing or during scanning is known in the field of the serial printer. One of the techniques of controlling the damage of the head pin includes detecting both edges of a paper sheet when the paper sheet is fed, and causing the printhead not to print outside the paper sheet.

According to another technique, an optimum gap is set by controlling a carriage as a driver of a printing mechanism and a paper guide driving motor in response to a paper width detected by an optical paper-thickness detector.

According to yet another technique, when the printhead is in a print disabled area close to an edge of paper, print data corresponding to the area is discarded, and paper transportation only is performed with the scanning of the printhead suspended.

The above-described techniques are disclosed in Japanese Unexamined Utility Model Application Publication No. 05-028650 and Japanese Laid-open Patent Publication No. 08-207381.

According to another technique, a change in the color of the paper and platen is detected, and the change of the color is thus determined as the edge of the paper. However, if a ruler line is pre-printed on the paper itself, the change in the color within the paper may be erratically recognized as the edge of the paper. If the change is erratically recognized as the edge of the paper, printing is not performed even within a printable area of the paper. Printing is desirably performed on a printing area with such an erratic recognition controlled. To this end, a user may turn off a paper-width detection sensor while printing.

When printing is performed on a paper sheet having a width smaller than a printable range with the sensor switched off, the edge of the paper sheet is not detected. The head pin may be caught and damaged on the edge of the paper. The head pin may be caught and damaged by other irregularities, such as a step in the thickness of a plurality of stacked paper sheets and a punch hole formed in the paper sheet. In the printing process of the serial printer, the printhead slides as the head pin, after being driven toward the paper, is retracted to the printhead. If the head pin is driven to an area such as a punch hole other than the paper, the printhead starts to move before the head pin is fully retracted in the printhead. The head pin may thus be caught on the paper.

SUMMARY

According to an aspect of the invention, a printer includes a memory that memorizes a value of a maximum stroke and a processor that executes a process. The process includes calculating a maximum stroke time that lasts from when a print pin arranged in a printhead is projected from the printhead by the maximum stroke to when the print pin is retracted in the printhead, setting an adjustment printing area on the printing medium, and switching a movement timing of the printhead in accordance with the maximum stroke time when a printing position of the printhead falls within the adjustment printing area set on the printing medium.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

First Embodiment

Figure 1:
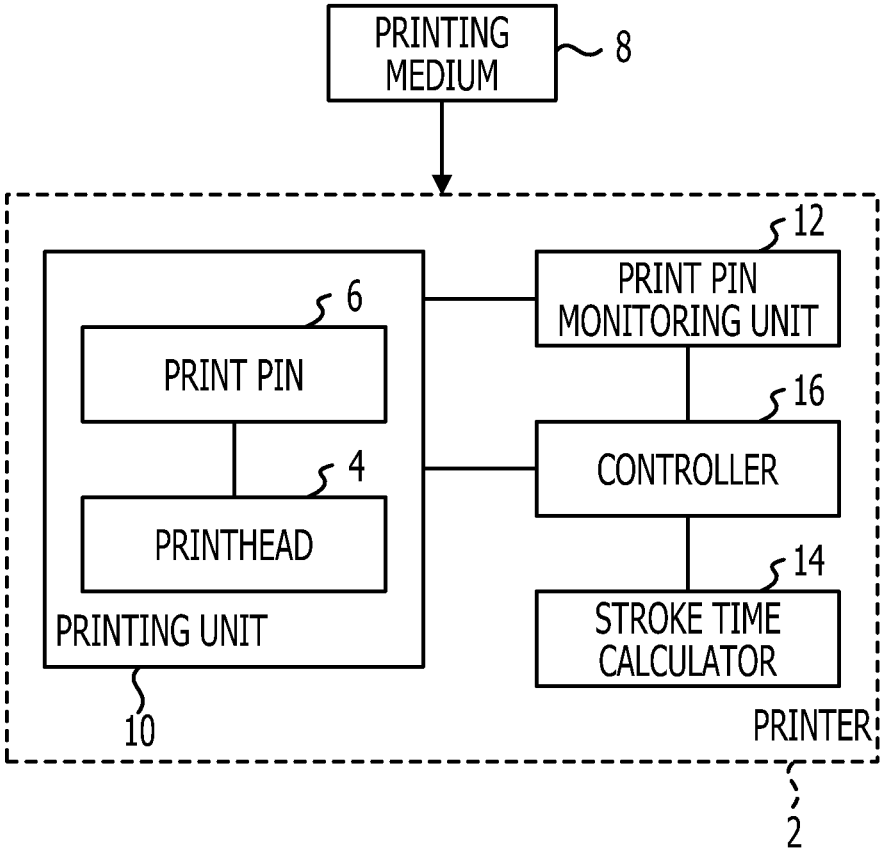
FIG. 1 is a functional block diagram illustrating a printer of a first embodiment.

FIG. 1 is a functional block diagram illustrating a printer 2 of a first embodiment. The printer of the embodiments is not limited to the structure illustrated in FIG. 1.

The printer 2 is an example of the disclosure of the embodiments. The printer 2 is provided with a function that controls the risk of damage of a print pin 6 mounted on a printhead 4 as a result of touching part of a printing medium 8. The printing medium 8 may include one printing paper sheet or a plurality of printing paper sheet stacked. The printing medium 8 may also include a paper sheet having a blank page on a printing surface thereof, a paper sheet having a ruler line or a character pre-printed thereon, or a copying paper sheet including a plurality of sheets laminated.

The printer 2 is a serial printer including a printing unit 10 having the printhead 4 and a print pin 6. The printer 2 includes print pin monitoring unit 12, stroke time calculator 14, and controller 16.

In the printer 2, an adjustment printing area is set on part or whole of the printing medium 8 to control damage to the print pin 6. In the adjustment printing area, a movement timing of the printhead 4 in a first scan direction is modified.

The printhead 4 includes a plurality of print pins 6. In a printing process, the printhead 4 moves in the first scan direction over the printing medium 8 such that the print pins 6 are carried to a printing position of each character to be printed. The printhead 4 is set at a placement height in accordance with a thickness of the printing medium 8 that is transported. The placement height is so set that the print pins 6 are lowered down onto the top surface of the printing medium 8 at an appropriate pressure.

The print pins 6 are projected from the printhead 4 in a shape of a character or a symbol to be printed. The print pins 6 are in contact with the printing medium 8 and pressed onto the printing medium 8 at a specific pressure. When the printing process has been performed, the print pins 6 are retracted back into the printhead 4. The printhead 4 starts to move in the first scan direction at the timing the print pins 6 are drawn out of contact with the printing medium 8.

The printing unit 10 performs a lowering operation and a raising operation of the print pins 6 in accordance with print data, and a movement operation of the printhead 4 in the first scan direction. The printing unit 10 includes, in addition to the printhead 4 and the print pins 6, a drive unit (not illustrated) to move the printhead 4 in the first scan direction.

The print pin monitoring unit 12 monitors the state of the print pins 6. For example, the print pin monitoring unit 12 detects whether the print pins 6 are retracted in the printhead 4, using a sensor arranged in the printhead 4. The print pin monitoring unit 12 includes a time measuring unit such as a timer. In a stroke time calculation operation of the print pins 6 to be discussed below, the print pin monitoring unit 12 detects whether the print pins 6 are retracted in the printhead 4. In a damage control process for the print pins 6, the print pin monitoring unit 12 performs a counting operation to move the printhead 4 in the first scan direction, and a monitoring operation of the retraction state of the print pins 6.

The print pin monitoring unit 12 may monitor a maximum projection state of the print pins 6, for example.

The stroke time calculator 14 calculates a stroke time that lasts until the print pins 6 are attracted into the printhead 4. For example, the stroke time calculator 14 calculates a maximum stroke time for the print pins 6 to be in a maximum stroke state, or a stroke time of the print pins 6 resulting from a set height of the print-head 4. Those stroke times may be calculated based on the monitoring results of the projection state by the print pin monitoring unit 12.

The stroke time calculator 14 calculates a length of time that lasts from when the print pins 6 are projected out of the printhead 4 to when the print pins 6 are retracted in the printhead 4. The stroke time calculator 14 may also calculate as the stroke time a length of time that lasts from when the print pins 6 are projected at a maximum projected state to when the print pins 6 are refracted in the printhead 4.

The controller 16 sets the adjustment printing area on the printing medium 8 set in the printer 2. The adjustment printing area refers to a control area where the edge of the printing medium 8 is supposed to be present and where a punch hole is supposed to be drilled on the printing medium 8. The adjustment printing area may be set on part or whole of the surface of the printing medium 8. The adjustment printing area may be set in accordance with control information input and set on the printer 2, or control information pre-stored on the printer 2. When the printhead 4 reaches the adjustment printing area, the controller 16 performs an adjustment printing process. In the adjustment printing process, the controller 16 modifies a movement timing of the printhead 4 in the first scan direction in response to the calculated maximum stroke time. In the modification of the movement timing, the printhead 4 does not move in the first scan direction and waits on standby until the print pins 6 are retracted.

The controller 16 outputs an execution instruction of the adjustment printing process to one of the printing unit 10 and the print pin monitoring unit 12. Upon receiving the execution instruction, one of the printing unit 10 and the print pin monitoring unit 12 sets the calculated maximum stroke time as the standby time of the printhead 4, thereby performing a movement control process on the printhead 4.

Figure 2:
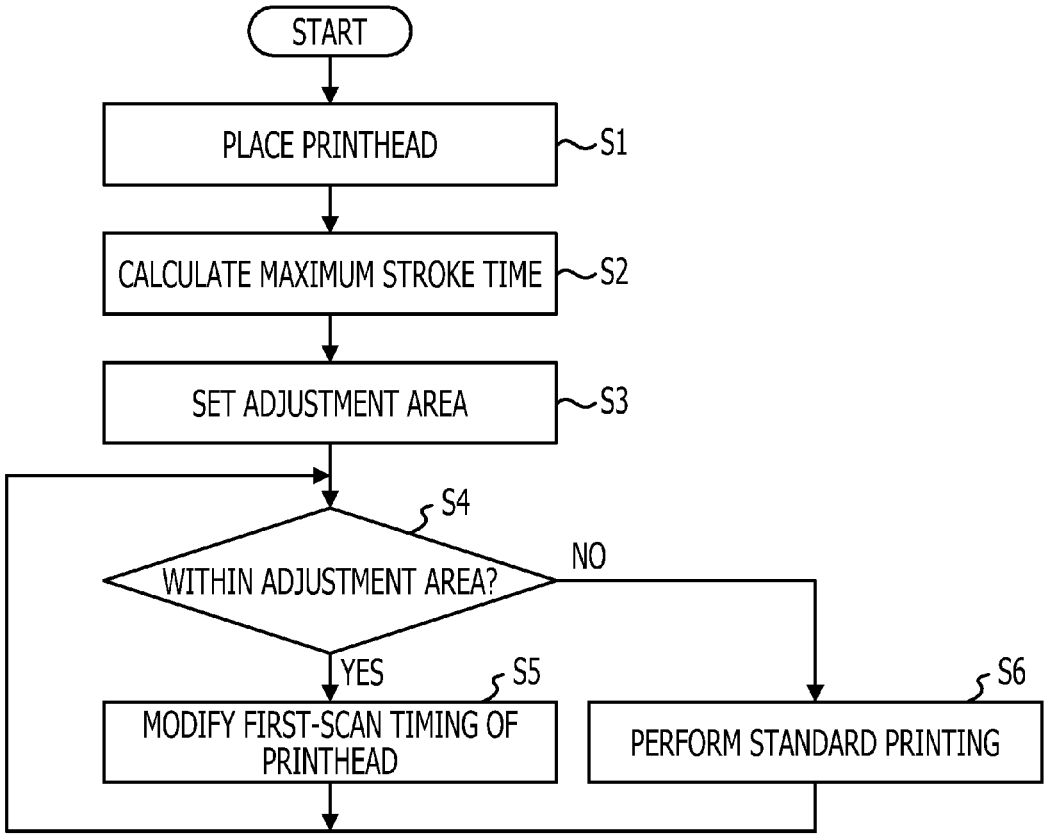
FIG. 2 is a flowchart illustrating an example of a printing control process.

FIG. 2 is a flowchart illustrating an example of the printing control process. The process content and the process procedure illustrated in FIG. 2 are illustrated for exemplary purposes only, and the printing control process of the embodiment is not limited to those of FIG. 2.

The printing control process is a process example to be executed by a printing control program disclosed herein. A pre-printing process to the printing control process includes setting a stroke of the print pins 6 with respect to printing paper, such as the printing medium 8, set on the printer 2, and setting the adjustment printing area. During the printing process, the controller 16 switches between a standard printing process and an adjustment printing process depending on whether a printing position is within an adjustment area set in the adjustment printing area or not.

When the printing paper as the printing medium 8 is set on the printer 2, the controller 16 performs a placement process of the printhead 4 (S1). In the placement process, the controller 16 sets a placement height of the printhead 4 in accordance with a thickness of the printing paper set. More specifically, the printhead 4 is placed from the printing medium 8 by a specific gap in addition to the thickness of the printing paper.

The stroke time calculator 14 calculates a maximum stroke time (S2). The stroke time calculator 14 calculates the maximum stroke time based on pre-stored information of a length and strike speed of the print pins 6. Alternatively, information of the maximum stroke time may be stored on a memory and the controller 16 may then read the information from the memory to set the maximum stroke time.

Alternatively, the stroke time calculator 14 may calculate the maximum stroke time based on information regarding the thickness and type of a paper sheet fed to the printer 2.

When the paper sheet is set on the printer 2 with the maximum stroke time set, the controller 16 sets the adjustment area where adjustment printing is to be performed (S3). In the setting of the adjustment area, the controller 16 sets a travel length of the printhead 4 in the first scan direction, i.e., the number of characters to be printed per line on the printing paper, a transport length of the printing paper in a second scan direction, and the number of lines per printing paper sheet, with respect to the position of the printhead 4 that is ready for printing.

When the setting process is complete, the printing process starts. In the printing process, it is determined whether the position of the printhead 4 is within the adjustment area (S4). This determination operation may be performed by the controller 16. The controller 16 learns the position of the printhead 4 with respect to the printing paper from the starting position of printing, the number of characters to be printed, and the transport length of the printing paper, and the controller 16 thus determines whether the printhead 4 is within the adjustment area.

If the present position of the printhead 4 is within the adjustment area (yes from S4), the controller 16 outputs to the printing unit 10 an entry instruction to enter the adjustment printing process, and modifies the movement timing of the printhead 4 in the first scan direction (S5). In the adjustment printing process, the controller 16 performs a drive control process on the driver of the printhead 4, thereby causing the printhead 4 to wait on standby until the calculated maximum stroke time has elapsed. More specifically, the controller 16 moves the printhead 4 in the first scan direction after the print pins 6 are fully retracted in the printhead 4.

If the present position of the printhead 4 is not within the adjustment area (no from S4), the controller 16 causes the printhead 4 to move at a standard first-scan timing (S6).

With the above-described arrangement, the edge of the printing medium, and an area of a punch hole may be set as the adjustment area. The risk that the print pins 6 are damaged by the printing medium 8 is reduced by modifying the first-scan timing of the printhead 4 within the adjustment area. A damage control area is limited regardless of printed contents of pre-printed paper. It is not necessary to extend the damage control area over the entire surface of a printing paper sheet that presents difficulty in paper width measurement. The printing process is efficiently performed. The first-scan timing of the printhead 4 is modified using the maximum stroke time of the print pins 6. The above-described simple arrangement controls the risk of damage of the print pins 6 regardless of the number and thickness of paper sheets.

Second Embodiment

Figure 3:
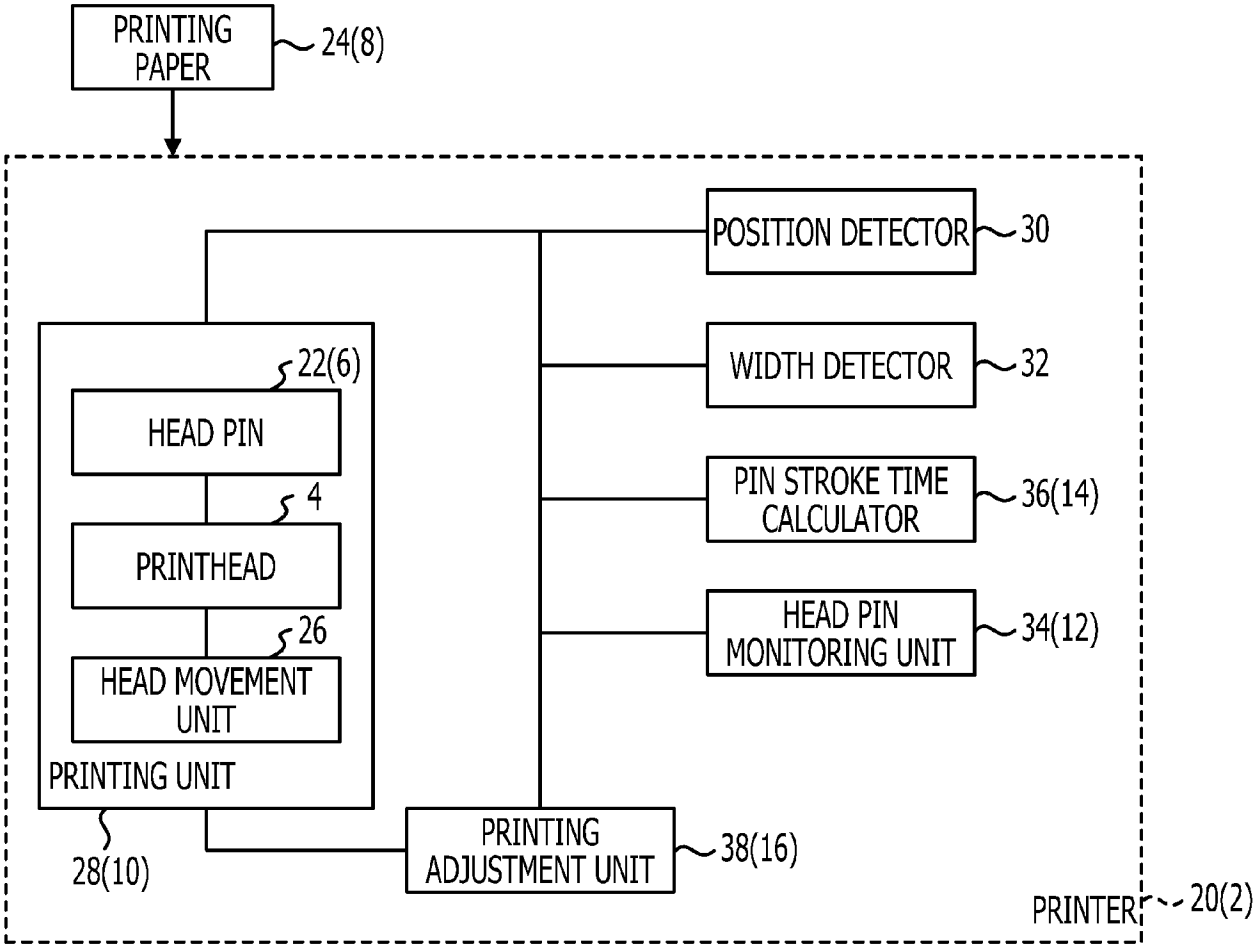
FIG. 3 is a functional block diagram illustrating a printer of a second embodiment.

FIG. 3 is a functional block diagram illustrating a printer 20 of a second embodiment. The structure of FIG. 3 is illustrated for exemplary purposes only, and the printer of the embodiments is not limited thereto. As illustrated in FIG. 3, elements identical to those illustrated in FIG. 1 are designated with the same reference numerals.

The printer 20 is an example of the disclosure herein. The printer 20 prints when head pins 22 strike the printing paper 24 of a single paper sheet or a plurality of paper sheets stacked. If the head pins 22 strike the printing paper 24 outside the printing surface thereof in the printer 20, the adjustment printing process is so performed as to control the damage of the head pins 22 that could possibly be caused by the printhead 4 moving in the first scan direction. The printer 20 includes printing unit 28, position detector 30, width detector 32, head pin monitoring unit 34, pin stroke time calculator 36, and printing adjustment unit 38.

The head pins 22 are an example of the print pins, and are arranged within the printhead 4. In the printing process, the head pins 22 are projected from the printhead 4 and pressed into contact with the printing paper 24. Some or all of the head pins 22 are constructed of a fine metal wire. The head pins 22, when in contact with the printing paper 24, are elastically deformed so that the head pins 22 are not broken or do not penetrate the printing paper 24.

The printing paper 24 is an example of the printing medium. The printing paper 24 may include a stack of a plurality of paper sheets identical in size or type, or a multilayer paper sheet that is produced by laminating paper sheets and a copying paper sheet different from the paper sheets in size and type and interposed between the paper sheets.

The printing unit 28 is an example of a printing unit that prints on the printing paper 24. The printing unit 28 includes the printhead 4 having the head pins 22 and a head movement unit 26. The head movement unit 26 moves the printhead 4 with respect to the printing paper 24 in the first scan direction. For example, the head movement unit 26 moves the printhead 4 to a printing position on the printing paper 24.

The position detector 30 is an example of a printing medium detector that monitors the presence or absence of the printing paper 24, an amount of feed of the printing paper 24 to the printer 20, and the upper edge position of the printing paper 24. The position detector 30 may be an optical sensor, for example. The position detector 30 detects at least one of the top edge and the bottom edge of the printing paper 24.

The width detector 32 detects the left edge only or both the left and right edges of the printing paper 24 set in the printer 20. The width detector 32 may be an optical sensor, and acquires information of the edge position and width of the printing paper 24.

The head pin monitoring unit 34 is an example of a state monitoring unit of the head pins 22. The head pin monitoring unit 34 may have a function of measuring the stroke time of the head pins 22. The head pin monitoring unit 34 may include a sensor that detects that the head pins 22 are retracted in the printhead 4.

The pin stroke time calculator 36 calculates the maximum stroke time during which the printhead 4 is set to wait on standby in the adjustment printing process. The maximum stroke time is a time of length lasting from when the head pins 22 are projected by a maximum stroke to when the head pins 22 are refracted in the printhead 4.

The printing adjustment unit 38 is an example of a controller that performs the adjustment printing process. The printing adjustment unit 38 sets the adjustment printing area on the printing paper 24. If the printhead 4 is within the adjustment printing area, the printing adjustment unit 38 outputs to the printing unit 28 a control instruction to cause the printhead 4 to wait on standby until the calculated maximum stroke time has elapsed.

Figure 4:
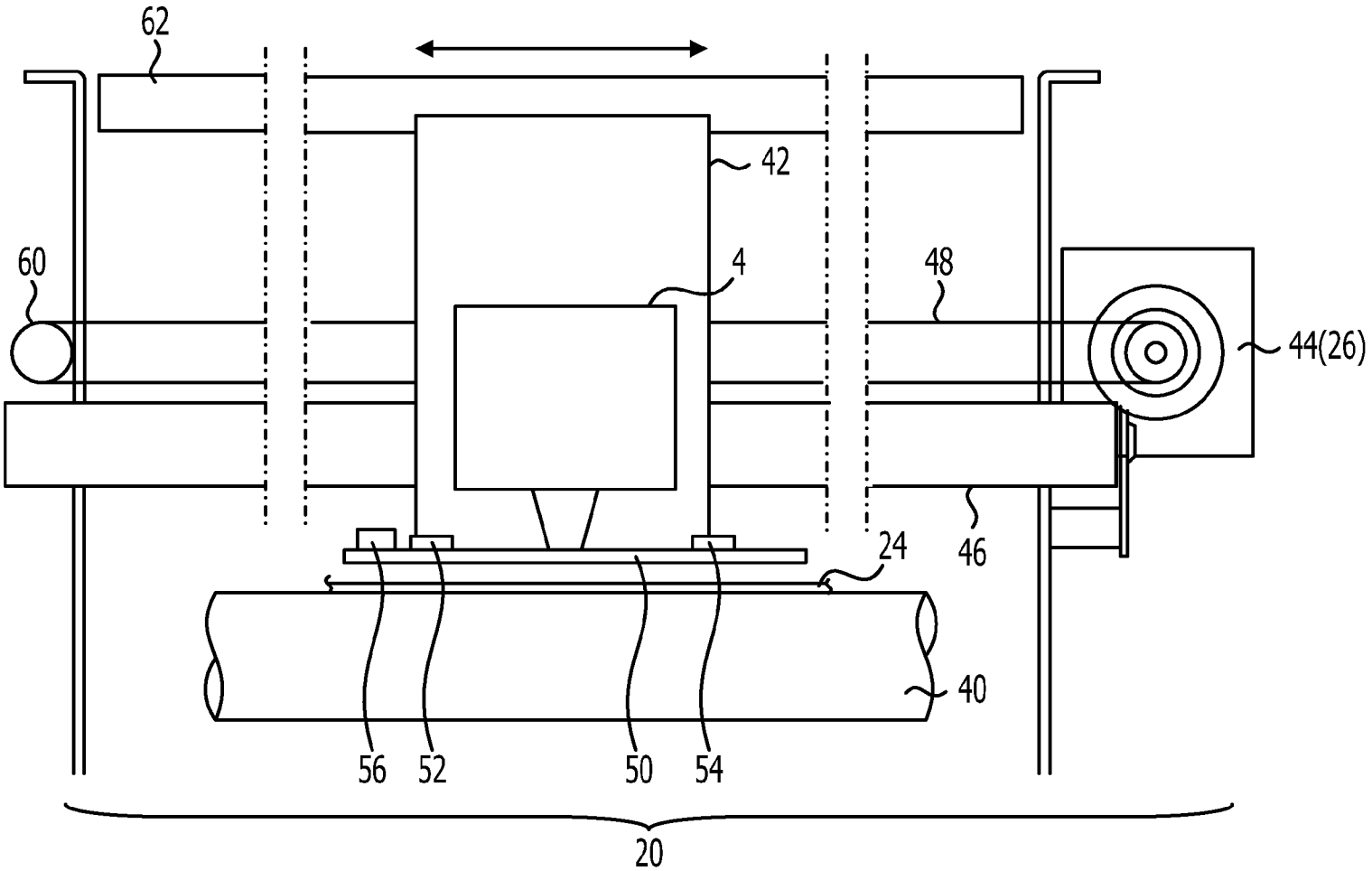
FIG. 4 illustrates an example of a structure of a printhead and elements associated therewith.
Figure 5:
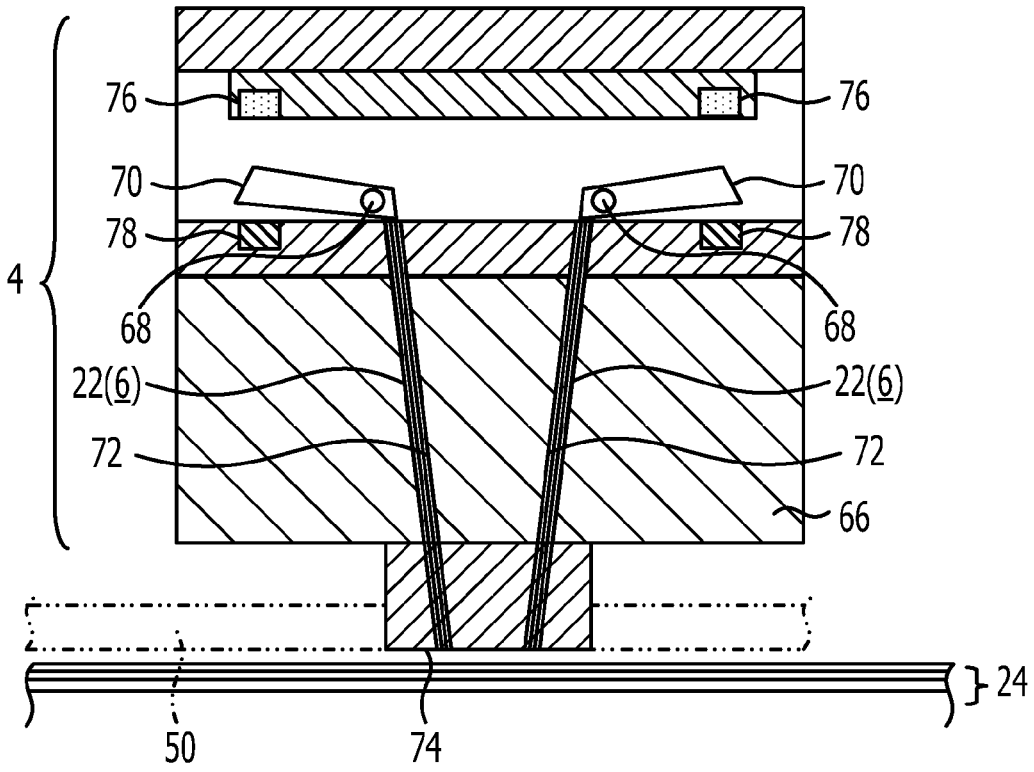
FIG. 5 illustrates an example of an internal structure of the printhead.
Figure 6:
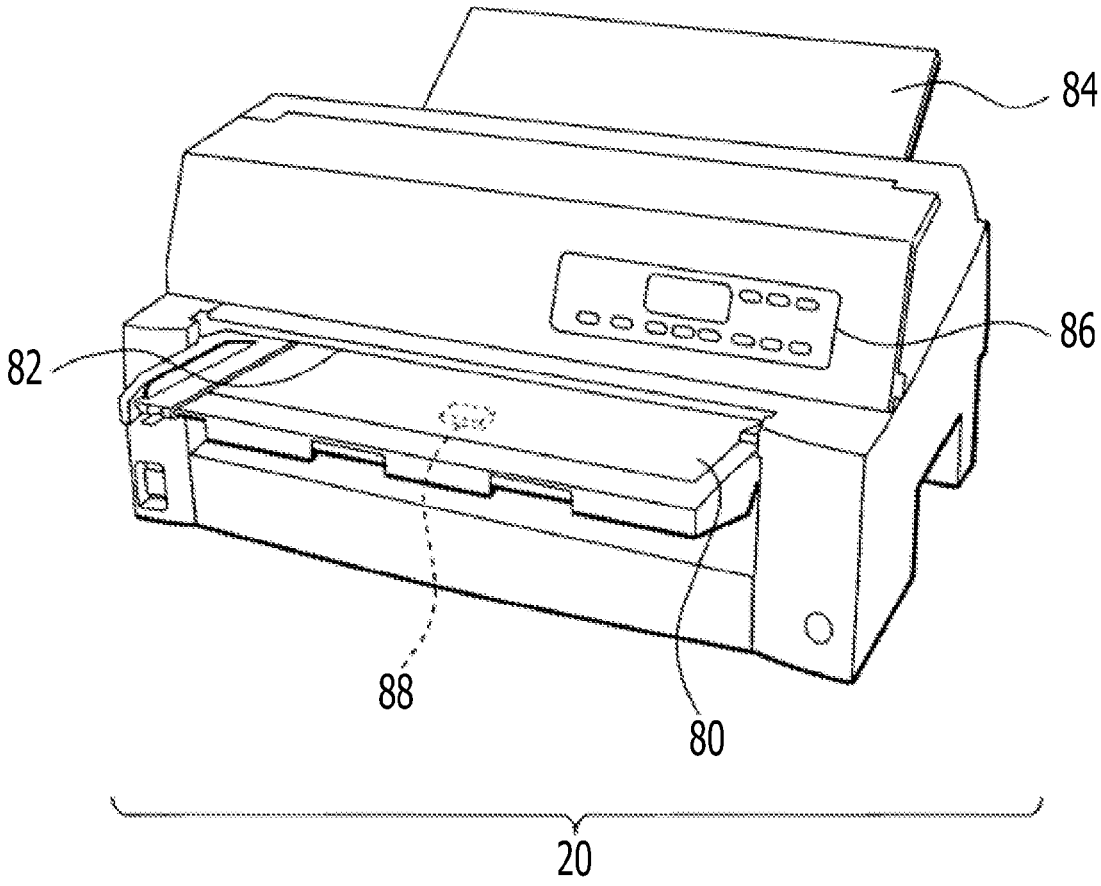
FIG. 6 is an external view of the printer.
Figure 7:
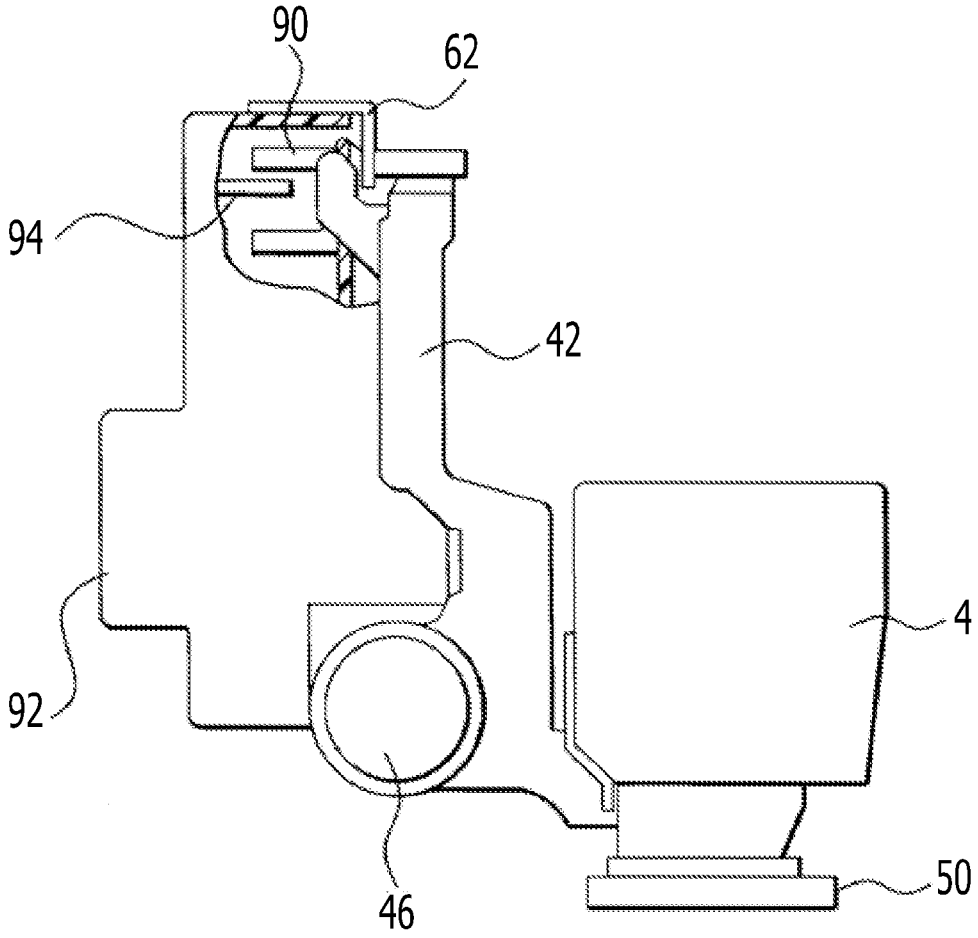
FIG. 7 is a rear view of the printhead.
Figure 8:
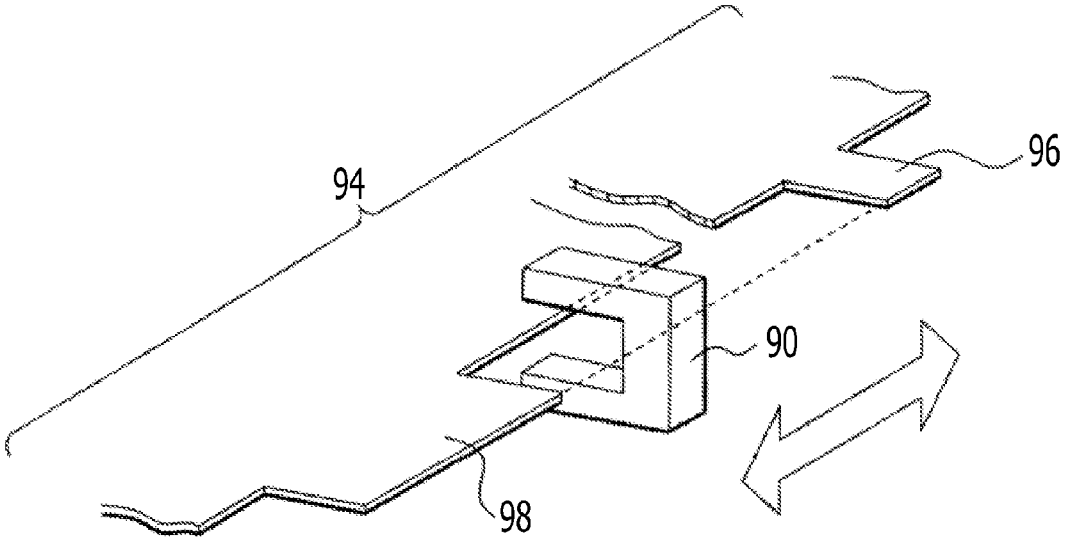
FIG. 8 illustrates a slide control unit of the printhead.

The specific structure of the printer is described with reference to FIGS. 4 through 8. FIG. 4 illustrates an example of a structure of the printhead 4 and elements associated therewith. FIG. 5 illustrates an example of an internal structure of the printhead 4. FIG. 6 is an external view of the printer 20. FIG. 7 is a rear view of the printhead 4. FIG. 8 illustrates a slide control unit of the printhead 4. The structures of FIGS. 4 through 8 are illustrated for exemplary purposes only. The printer 20 of the embodiment is not limited to those structures illustrated herein.

The printer 20 of FIG. 4 includes platen roller 40 where the printing paper 24 is placed, carrier unit 42 holding the printhead 4, space motor 44, and guide stay 46.

The platen roller 40 receives the printing paper 24 in a manner such that the printing paper 24 is aligned with the printing surface thereof kept in parallel with the printhead 4. The platen roller 40 also transports the printing paper 24 in a second scan direction. The platen roller 40 is rotated in synchronization with a printing timing, transporting the printing paper 24 in the second scan direction and thus performing carriage return and line feed to the printhead 4 to a printing position thereof. The platen roller 40 may be manufactured of resin or metal, and may be colored in a color such that a border thereof with the placed printing paper 24 is discriminated.

The carrier unit 42 holds the printhead 4 and the like. The printhead 4 is held by the carrier unit 42 in a vertically movable fashion. A print gap having a specific height is set on the printhead 4 held by the carrier unit 42 with respect to the printing surface of the printing paper 24. The carrier unit 42 is movable in parallel with the platen roller 40. The printhead 4 thus arranged moves across the printing surface of the printing paper 24 in the first scan direction. The carrier unit 42 is slidably supported by the guide stay 46 that passes through the carrier unit 42. The carrier unit 42 is also supported by a carrier belt 48 driven by the space motor 44.

The carrier unit 42 includes a guide member 50 that extends in parallel with the platen roller 40. The guide member 50 is an example of an adjuster of the printing position of the printing paper 24. The guide member 50 is substantially flush with an area of the printhead 4 surrounding a hole that accommodates the head pins 22 (FIG. 5). In the setting of a print gap, a height of the printhead 4 is set with reference to a height of the guide member 50 that allows the guide member 50 to be in contact with the printing paper 24. The guide member 50 may also include a plurality of paper width sensors 52 and 54 that detect the width of the printing paper 24, and a paper thickness sensor 56 that acquires information of the thickness of the printing paper 24.

The paper width sensor 52 is an example of a width detector unit that detects the left edge of the printing paper 24 placed on the printer 20. The paper width sensor 54 is an example of the width detector unit that detects the right edge of the printing paper 24. The paper width sensors 52 and 54 may be color recognition sensors. For example, the paper width sensors 52 and 54 detect the edge of the printing paper 24 by detecting a change that takes place between a white printing paper 24 and a black platen roller 40 when the carrier unit 42 moves in the first scan direction. The paper width sensors 52 and 54 may be reflective type sensors that, if the printing paper 24 is present, detect light reflected from the printing paper 24, and, if the printing paper 24 is not present, detect no light because light is absorbed by the platen roller 40.

The paper width sensors 52 and 54 in the printer 20 detect at least one of the top edge, the left edge, the right edge, and the bottom edge of the printing paper 24. In accordance with edge information of the printing paper 24 detected first, the printer 20 determines thereafter the edge at the same location thereafter using the detection result. The printer 20 thus uses the detection result as a first printing position.

When the printhead 4 is moved toward the platen roller 40, the paper thickness sensor 56 acquires thickness information of the printing paper 24 from a height at which the printhead 4 reaches the top surface of the printing paper 24.

The space motor 44 is included in the head movement unit 26 that moves the carrier unit 42 in the first scan direction with the printhead 4 held thereon. The space motor 44 drives the carrier unit 42 in steps of a specific space. The printer 20 includes the space motor 44 on one of the left or right end of thereof, and a pulley 60 on the other end opposed to the end having the space motor 44. The space motor 44 and the pulley 60 are arranged at the same level, and are linked via a carrier belt 48. The carrier belt 48 is secured on the rear side of the carrier unit 42.

The carrier unit 42 is moved in the first scan direction by the carrier belt 48 which is rotated by the space motor 44. The space motor 44 is so set as to rotate by a specific amount of rotation. For example, the amount of rotation may move the carrier unit 42 by one character to be printed on the printing paper 24.

The guide stay 46 guides the carrier unit 42 such that the carrier unit 42 moves in parallel with the printing surface of the printing paper 24. The guide stay 46 also serves as a shaft supporting the printhead 4, the guide member 50, and the carrier unit 42. The guide stay 46 is arranged in parallel with the platen roller 40. When the carrier unit 42 moves along the guide stay 46, the printer 20 prints linearly on the printing paper 24 in the first scan direction.

The printer 20 further includes a guide 62 that remains in contact with the top side of the carrier unit 42.

The plurality of head pins 22 are projectably arranged within a casing 66 of the printhead 4 of FIG. 5. In a head pin 22, a pin portion 72 and an arm portion 70 are supported on a pivot 68. The arm portion 70 is arranged inside the upper portion of the printhead 4. The pin portion 72 extends to a head face 74 formed on the bottom of the printhead 4. The head face 74 is in parallel with the printing paper 24. Projection holes of the number corresponding to the number of the head pins 22 are drilled in the head face 74. Through the projection holes, the head pins 22 are projected outward.

An electromagnetic solenoid 76 is arranged as a driver in alignment with the position of the arm portion 70 within the printhead 4. The arm portion 70 is attracted by the electromagnetic solenoid 76 that is energized in response to a drive instruction of the head movement unit 26 (FIG. 3). Based on the lever rule, the arm portion 70 rotates about the pivot 68, thereby pushing the pin portion 72 down and projecting the tip of the pin portion 72 out of the head face 74. When the electromagnetic solenoid 76 is deenergized, resilience acting on the head pin 22 lowers the arm portion 70. The pin portion 72 is thus raised with the arm portion 70 turning about the pivot 68.

The printhead 4 also includes a pin sensor 78 for each head pin 22 as a state monitoring unit of the head pins 22. The pin sensor 78 is arranged on a position opposed to the electromagnetic solenoid 76 with the arm portion 70 interposed therebetween. The pin sensor 78, serving as a touch sensor, is designed to be electrically connected to the arm portion 70 when the head pins 22 are retracted in the printhead 4. While the arm portion 70 is attracted by the energized electromagnetic solenoid 76, the pin sensor 78 detects that the arm portion 70 is out of touch with the pin sensor 78. When the electromagnetic solenoid 76 is deenergized, the arm portion 70 touches the pin sensor 78. The pin sensor 78 thus detects that the arm portion 70 is out of touch with the pin sensor 78. When the deenergized electromagnetic solenoid 76 causes the arm portion 70 to touch the pin sensor 78, the pin sensor 78 detects a refraction state of the head pins 22.

The head pin monitoring unit 34 (FIG. 3) monitors as a stroke time of the head pins 22 a length of time from the transition of the pin sensor 78 from on to off to the transition of the pin sensor 78 from off to on. Alternatively, the head pin monitoring unit 34 may set the stroke time resulting from time counting starting when the electromagnetic solenoid 76 is deenergized to when the pin sensor 78 is turned on. More specifically, in the adjustment printing process, the supply timing of the energizing power to the electromagnetic solenoid 76 may be used as a timing of time counting of or controlling of the stroke time.

The printer 20 of FIG. 6 includes paper support unit 80, paper feeder unit 82, paper discharge unit 84, and display and operation unit 86. When the printing paper 24 is placed on the paper support unit 80, the paper feeder unit 82 automatically or manually feeds the printing paper 24 to the printer 20. The paper support unit 80 may include the paper sensor 88. The paper sensor 88 monitors or adjusts an amount of feed of the printing paper 24. The paper sensor 88 also operates as the position detector 30 that monitors whether the printing paper 24 is placed on the paper support unit 80. The paper sensor 88 also detects the lower edge of the printing paper 24.

The paper discharge unit 84 discharges from the printer 20 the printing paper 24 having undergone the printing process and holds the printing paper 24 therewithin.

The display and operation unit 86 includes a display panel that displays print status of the printer 20, and other notification information. The display and operation unit 86 also includes a plurality of operation buttons to enter an operation input to the printer 20. A user of the printer 20 sets a type of paper to be printed, and an adjustment area for adjustment printing, using the display and operation unit 86.

FIG. 7 illustrates the carrier unit 42 including a left-right end sensor (LRES) 90 on the back thereof. The LRES 90 is an optical sensor or an electrical switching sensor, having a C-shaped configuration. The LRES 90 is arranged at a height level corresponding to a height level of a screen plate 94 arranged within a space in a housing 92 on the back side of the carrier unit 42. The LRES 90 monitors a movement range of the printhead 4 and the carrier unit 42 in the first scan direction within the printer 20.

The LRES 90 of FIG. 8 moves between left and right projections 96 and 98 extended from the screen plate 94 as the carrier unit 42 moves in the first scan direction. When the LRES 90 comes to straddle one of the projection 96 and the projection 98, the LRES 90 detects that the carrier unit 42 or the printhead 4 has reached a movement limit position, and causes the space motor 44 to stop driving. If the printing process is performed to the movement limit position, the printer 20 causes the printhead 4 and the carrier unit 42 to return to an initial printing position, and performs a line-feed operation to resume printing.

Figure 9:
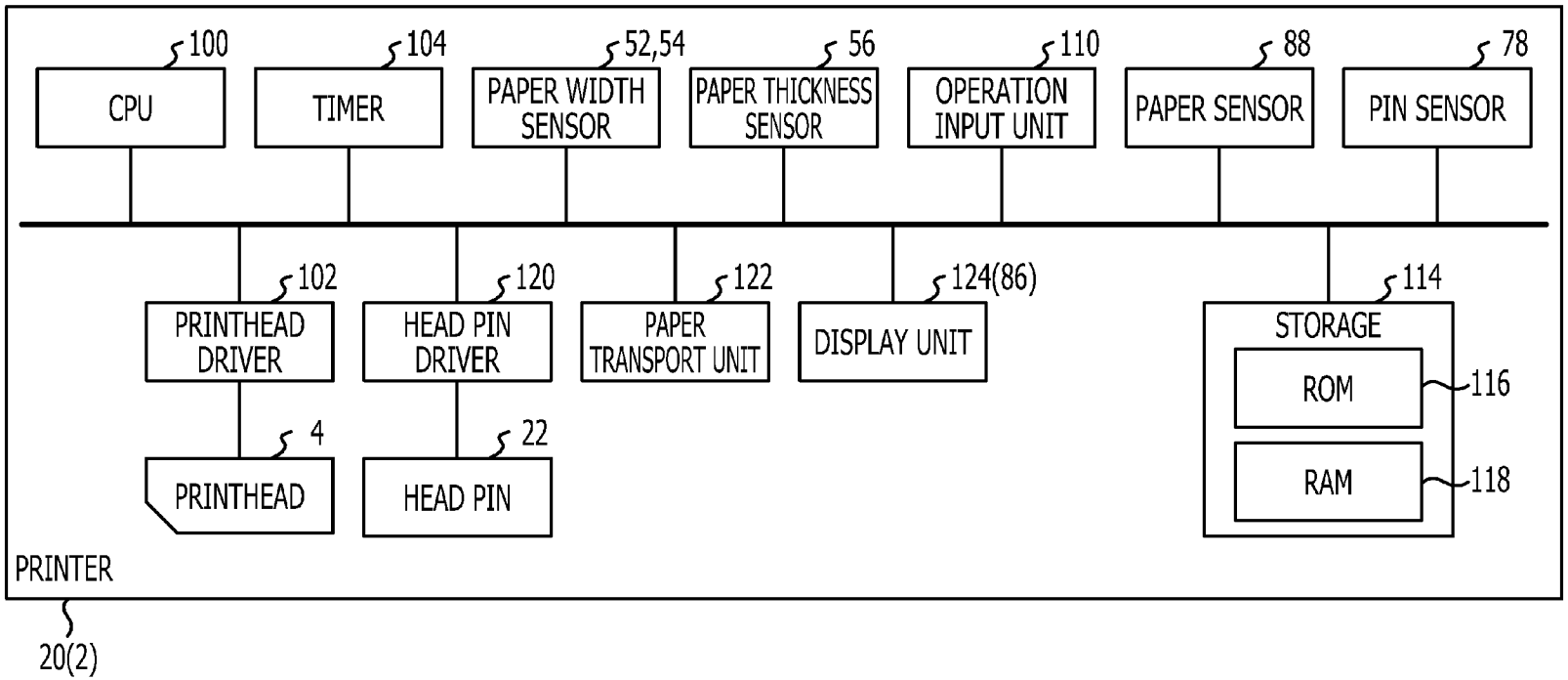
FIG. 9 illustrates an example of a hardware structure of the printer.

FIG. 9 illustrates an example of a hardware structure of the printer 20.

To execute the adjustment printing process, the printer 20 includes central processing unit (CPU) 100, printhead driver 102, timer 104, paper width sensors 52 and 54, paper thickness sensor 56, operation input unit 110, paper sensor 88, and storage 114. The printer 20 also includes head pin driver 120, paper transport unit 122, and display unit 124.

The CPU 100 executes operating system (OS), and a printing control program. By executing the printing control program, the CPU 100 sets the adjustment area for the adjustment printing, calculates the stroke time, and performs a printing control process including a printing position monitoring process of the printhead 4.

The printhead driver 102 controls the movement of the printhead 4 in the first scan direction by performing power supply control and rotating speed control of the space motor 44 (see FIG. 4).

The timer 104 measures the pin stroke time of the head pins 22. In the adjustment printing process, the printhead driver 102 controls the movement of the printhead 4 in accordance with the measurement results of the timer 104.

The operation input unit 110 monitors the setting input to the display and operation unit 86 of the printer 20.

The storage 114 includes a read-only memory (ROM) 116, and a random-access memory (RAM) 118. The ROM 116 may include a recording medium such as a hard-disk device or a flash memory, and stores the OS and the printing control program. The ROM 116 also stores setting information of the adjustment area, information of the calculated stroke time, information of the detected paper width, information of the paper width, and other information.

The ROM 116 may be an electrically erasable and programmable read only memory (EEPROM) that allows contents to be electronically rewritten.

The printing control program is not limited to the one stored on the ROM 116. For example, the printing control program may be the one stored on a computer readable recording media, including a magnetic disk, a flexible disk, an optical disk, and magneto-optical disk. The printing control program may be read from a server or a database present over a network.

The RAM 118 includes a work area for the printing control process. When the printing control program is executed, the RAM 118 functions as the printing adjustment unit 38.

The head pin driver 120 controls raising and lowering of the head pins 22 in response to the supply control to the electromagnetic solenoid 76. The head pin driver 120 is a switching circuit including the electromagnetic solenoid 76, and is connected to a power supply unit (not illustrated) of the printer 20.

The paper transport unit 122 transports the printing paper 24 set in the printer 20. The paper transport unit 122 includes the platen roller 40, and other transport rollers. In the printing process, the paper transport unit 122 transports the printing paper 24 in the second scan direction by a specific length at the timing when the printhead 4 has printed to the end of the printing paper 24.

The display unit 124 display the status of the printing process, and is the display and operation unit 86. The display unit 124 displays a print setting screen, an adjustment area setting screen, and a notification screen of alert. The display unit 124 may operate as a display control unit that notifies a host personal computer (PC) connected to the printer 20 of an alert notification.

Figure 10:
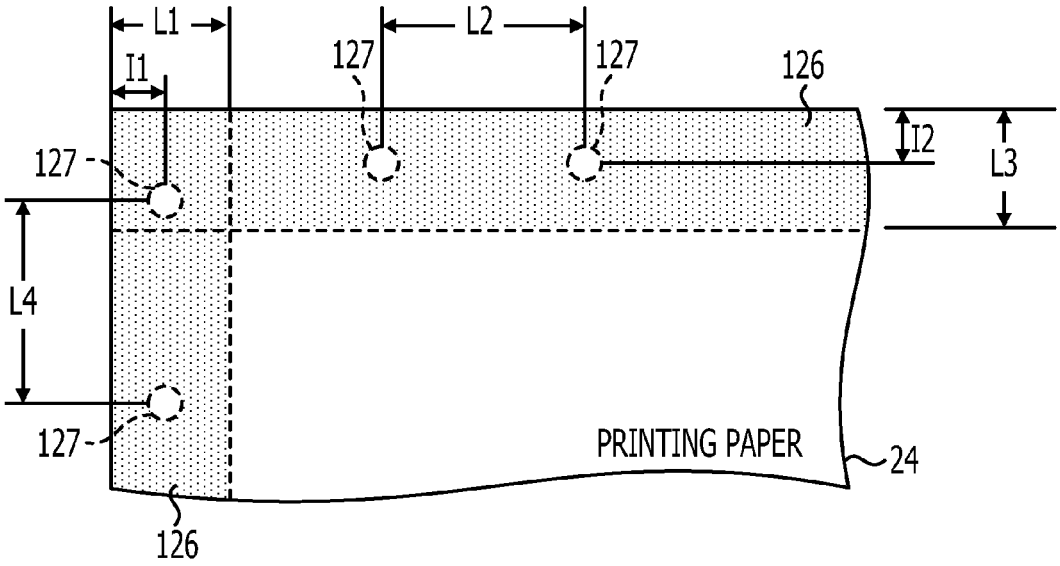
FIG. 10 illustrates an example of an adjustment area.
Figure 11:
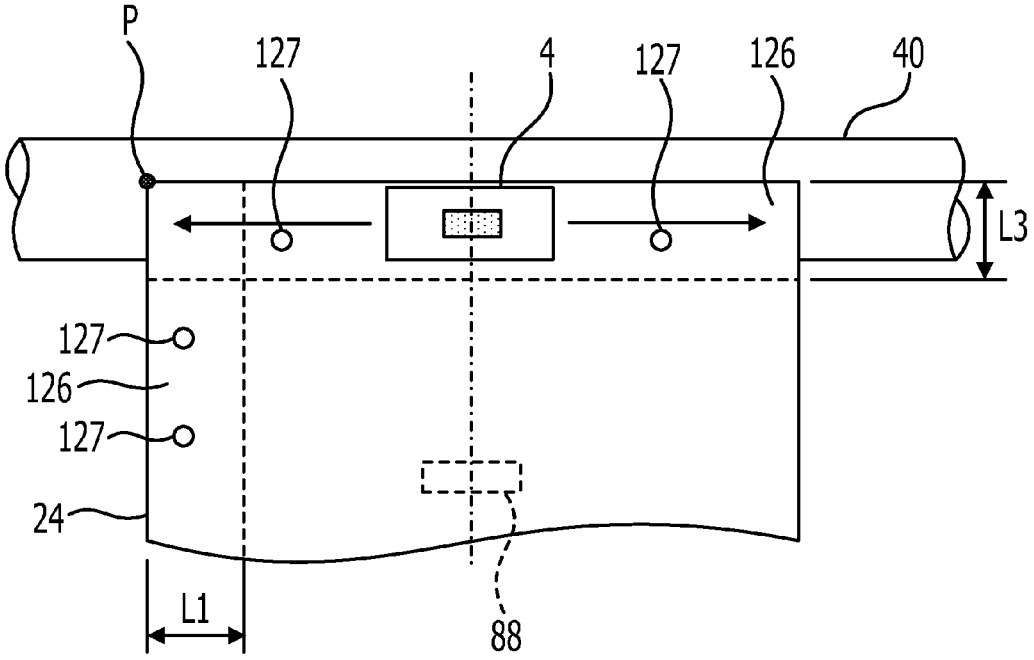
FIG. 11 illustrates a status of the printing process within the adjustment area.
Figure 12:
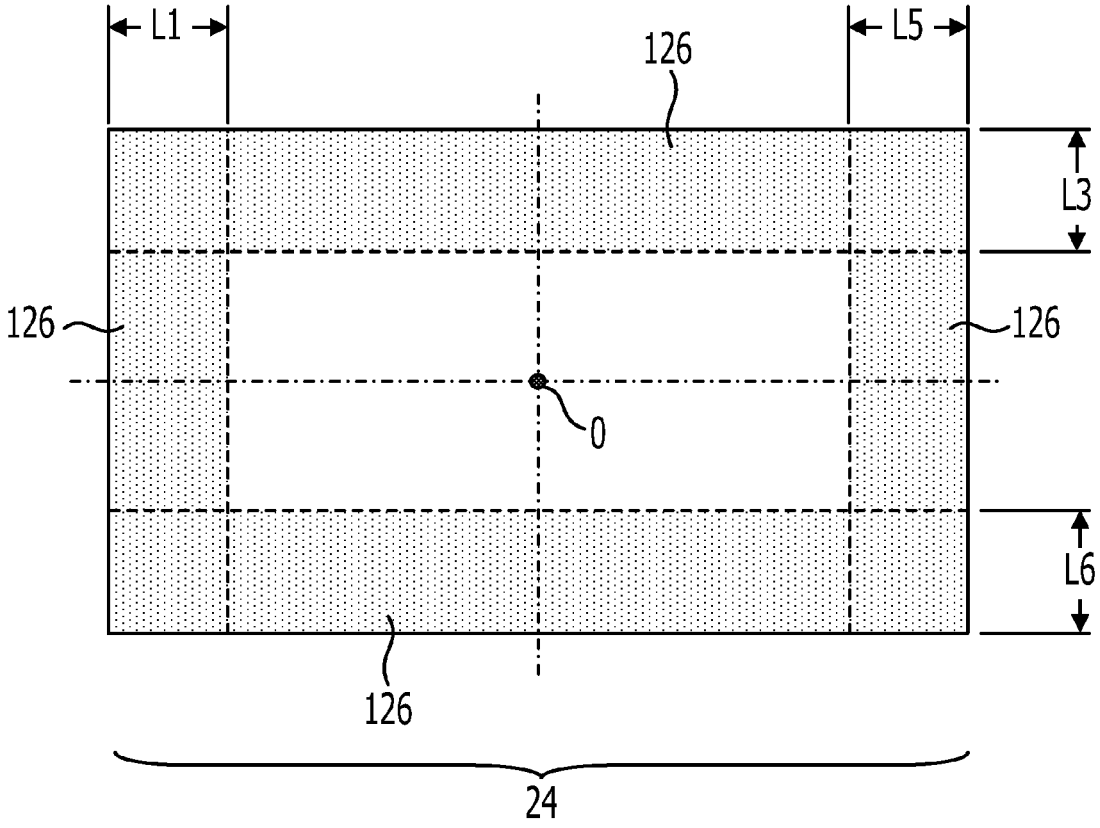
FIG. 12 illustrates an example of the adjustment area.
Figure 13:
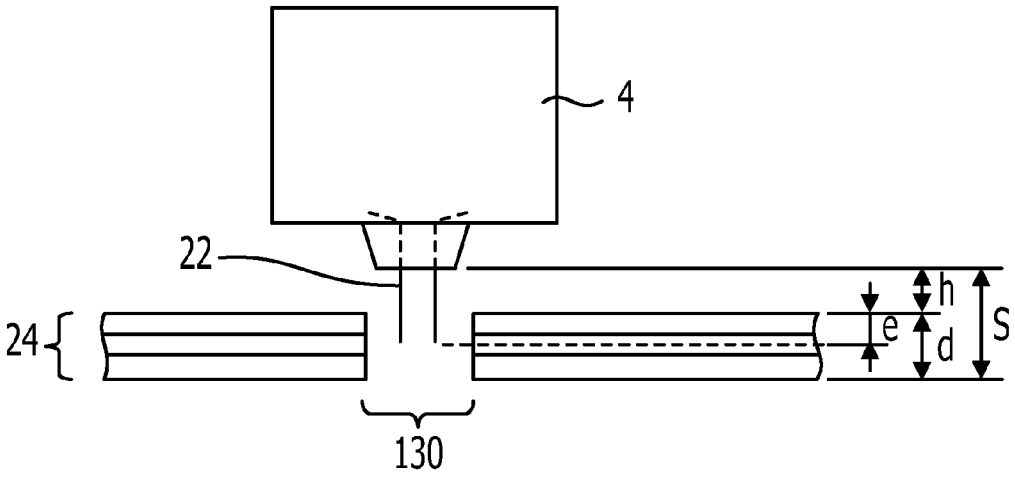
FIG. 13 illustrates a maximum stroke of the head pin.
Figure 14A:
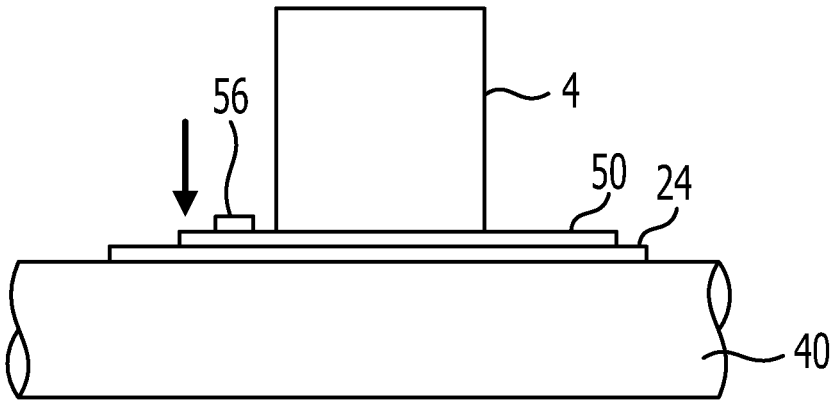
FIGS. 14A and 14B illustrate an example of a paper thickness detection process and a gap setting process.
Figure 14B:
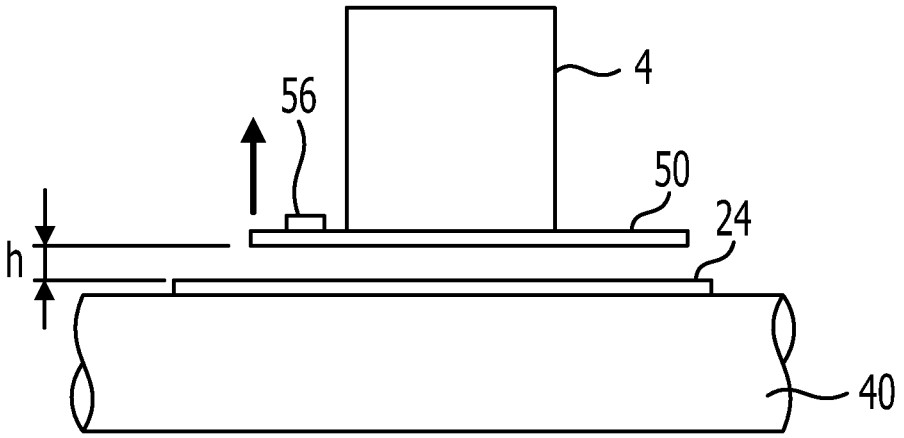
Figure 15A:
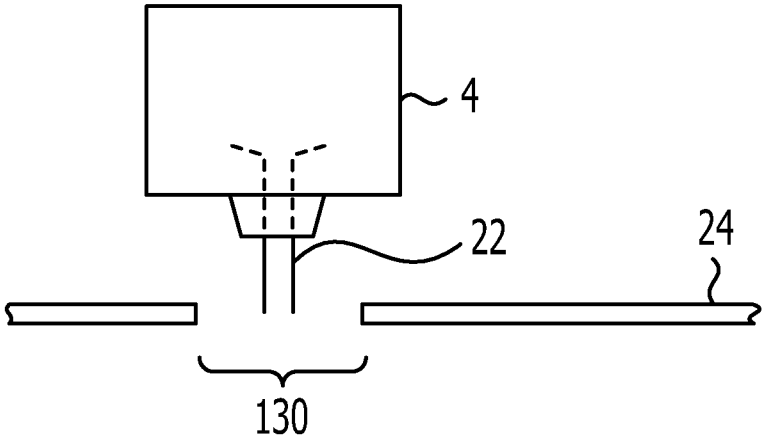
FIGS. 15A and 15B illustrate the principle of an adjustment printing process.
Figure 15B:
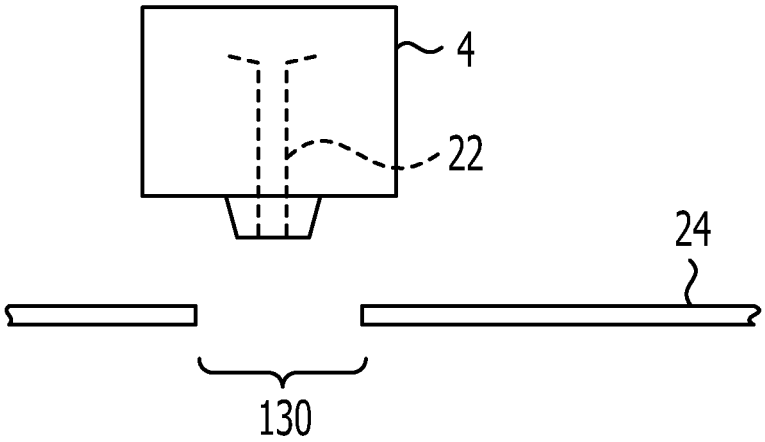
Figure 16:
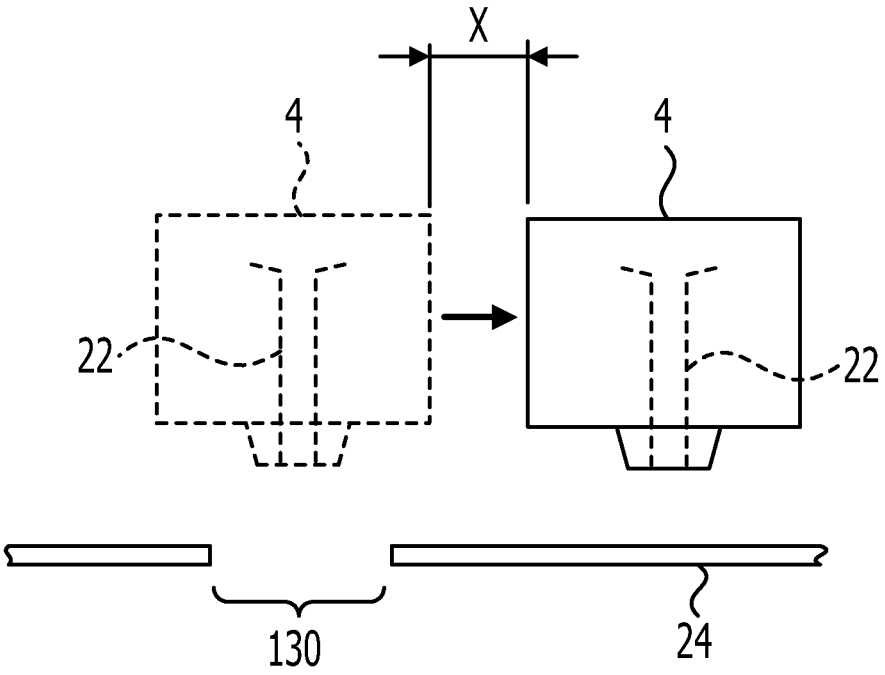
FIG. 16 illustrates the principle of the adjustment printing process.

The adjustment printing is described below with reference to FIGS. 10 through 16. FIG. 10 illustrates an example of an adjustment area. FIG. 11 illustrates a status of the printing process within the adjustment area. FIG. 12 illustrates an example of the adjustment area. FIG. 13 illustrates a maximum stroke of the head pin. FIGS. 14A and 14B illustrate an example of a paper thickness detection process and a gap setting process. FIGS. 15A and 15B illustrate the principle of an adjustment printing process. FIG. 16 illustrates the principle of the adjustment printing process. FIGS. 10 through 16 illustrate structures of elements of the printer 20 for exemplary purposes only, and the embodiments are not limited to those illustrated herein.

An adjustment area 126 is set on the printing paper 24 as illustrated in FIG. 10. The adjustment area 126 extends rightward from a detected left edge by a specific width L1 and extends downward from a top edge of the printing paper 24 by a specific distance L3. The adjustment area 126 includes a top edge portion and a left edge portion where punch holes 127 are likely to be formed. The punch holes 127 includes circular hole having a diameter of 6 mm centered at a position spaced from the left edge of the printing paper 24 by 13 mm as distance 11, and circular holes having a diameter of 6 mm centered at a position spaced from the top edge of the printing paper 24 by 13 mm as distance 12. A plurality of punch holes like those holes are formed along a straight line in a first direction and/or a second direction. The punch holes 127 are spaced from each other by distance L2 and by distance L4. Distance L2 and distance L4 may be 80 mm, for example.

In the adjustment printing process, the adjustment area 126 may include the formation areas of the punch holes 127, and the specific distances L1 and L3 may be 20 mm, for example.

In the adjustment printing process of the adjustment area 126, the printer 20 starts the printing process at a position P at the top right corner of the printing paper 24 detected by the paper width sensor 52 (FIG. 4) as illustrated in FIG. 11. In the adjustment printing process, the printer 20 causes the printhead 4 to wait on standby in the adjustment area 126 in response to a printing control instruction from the printing adjustment unit 38 until the head pins 22 are refracted in the printhead 4.

The printing adjustment unit 38 detects the number of movements of the printhead 4 in the first scan direction and the position of the printhead 4 over the printing paper 24 with respect to the detected position P serving as a reference. The position of the printhead 4 may be detected by referencing the number of rotations of the space motor 44 that moves the carrier unit 42 and the number of rotations of the platen roller 40. The printing adjustment unit 38 compares the detected position of the printhead 4 with the position information of the printing paper 24 set as the adjustment area 126, thereby determining whether to perform the adjustment printing.

The paper sensor 88 monitors the presence or absence of the printing paper 24 to be transported in the second scan direction, thereby detecting the lower edge of the printing paper 24. The printing adjustment unit 38 detects the end timing of the printing process to the printing paper 24 in accordance with the detection results of the paper sensor 88. The printing adjustment unit 38 stores information about distance from the paper sensor 88 to the printhead 4. Upon receiving the lower edge detection information of the printing paper 24 from the paper sensor 88, the printing adjustment unit 38 calculates the number of rotations of the platen roller 40 for the lower edge of the printing paper 24 to reach the printhead 4.

When the printing process of the printing paper 24 is complete, the printing process resumes on the next printing paper 24. The setting of the current adjustment area 126 may be used again, or a new adjustment area 126 may be set. Alternatively, the adjustment area 126 may be modified in accordance with a data size of the read print data.

The adjustment area 126 may be set on the right edge side and the lower edge side on the printing paper 24. If the printing paper 24 of FIG. 10 is fed to the printer 20 in an upside down fashion or a left side right fashion, the punch holes 127 are arranged on the right edge side and the lower edge side. In such a case, the printing adjustment unit 38 may detect the position of the adjustment area 126 along the right edge of the printing paper 24 with respect to the position P of the top left corner of the printing paper 24 as illustrated in FIG. 11. The printing adjustment unit 38 may also detect the adjustment area 126 along the lower edge of the printing paper 24 by referencing the lower edge detection information from the paper sensor 88.

As illustrated in FIG. 12, the adjustment area 126 may be set on the top, bottom, left and right edge portions of the printing paper 24. The adjustment area 126 is set within an area extending along a first direction from the left edge by distance L1, and an area extending along the first direction from the right edge by distance L5. The adjustment area 126 is also within an area extending along a second direction from the top edge by distance L3, and an area extending along the second direction from the bottom edge by distance L6. Distances L1, L5, L3, and L6 may be equal in width. Each of distances L1, L5, L3, and L6 may be set to be larger than the sum of a distance from each edge to the imaginary center of the punch holes 127 and the radius of the punch holes 127 or the diameter of the punch holes 127.

In the printhead 4 of FIG. 13, the head pins 22 are lowered into the punch holes 127 formed in the printing paper 24, thereby having a maximum stroke length. The printing paper 24 includes a plurality of paper sheets stacked to a thickness of d. For example, if the type of paper is 33 (kg), the thickness d=0.06×N (sheets). The type of paper here is represented by a weight resulting from stacking 1000 sheets of paper. The thickness d of the paper may be directly detected by the paper thickness sensor 56 (FIG. 4). The printhead 4 has a specific gap h to the top surface of the printing paper 24. More specifically, the printhead 4 is placed at the level of a height S from the placement surface of the platen roller 40. The height S is the sum of the thickness d of the printing paper 24 and the gap h.

When the head pins 22 in the printhead 4 is lowered into a punch hole 130, the head pins 22 is inserted by a length e from the top surface of the printing paper 24. Since the projection length of the head pins 22 is known, the insertion length e into the printing paper 24 is determined by the gap h. In the adjustment printing process, the maximum stroke time lasting from when the head pins 22 are projected by the maximum stroke length to when the head pins 22 are refracted in the printhead 4 is used.

In a thickness detection process of the printing paper 24 as illustrated in FIG. 14A, the printhead 4 is so lowered that the printhead 4 and the guide member 50 touch the top surface of the printing paper 24. The paper thickness sensor 56 detects the top surface of the printing paper 24 with respect to the placement surface of the platen roller 40 bearing the printing paper 24. Information of the detected height is then stored as a paper thickness d on the storage 114.

In a gap setting process of FIG. 14B, the printhead 4 and the guide member 50 are lifted by a height equal to the gap h from the top surface of the printing paper 24. The gap h is so set that the head pins 22 strike the top surface of the printing paper 24 at a specific pressure on the printing paper 24 in a manner free from any damage incurred on the head-pins 22. For example, the gap h is determined from a distance from the printing surface of the printing paper 24 regardless of the thickness of the printing paper 24. The pin stroke time is calculated after the thickness detection process and the gap setting process.

In the adjustment printing process of the adjustment area, the head pins 22, when lowered into the punch hole 130 of the printing paper 24, have a maximum stroke as illustrated in FIG. 15A. The printhead 4 of FIG. 15B waits on standby throughout the maximum pin stroke time. The maximum pin stroke time lasts from when the head pins 22 are projected by a maximum stroke to when the head pins 22 are retracted in the printhead 4.

When the maximum pin stroke time has elapsed, the printhead 4 of FIG. 16 moves in the first scan direction by a printing interval X corresponding to one character. Even if the printing process is performed in the punch hole 130, the printhead 4 remains stayed until the head pins 22 are fully retracted. In the adjustment printing process, the printer 20 keeps the printhead 4 waiting on standby until the maximum pin stroke time has elapsed. When the maximum pin stroke time has elapsed, the printer 20 determines, regardless of the projection length of the head pins 22, that the head pins 22 are reliably retracted in the printhead 4.

Figure 17:
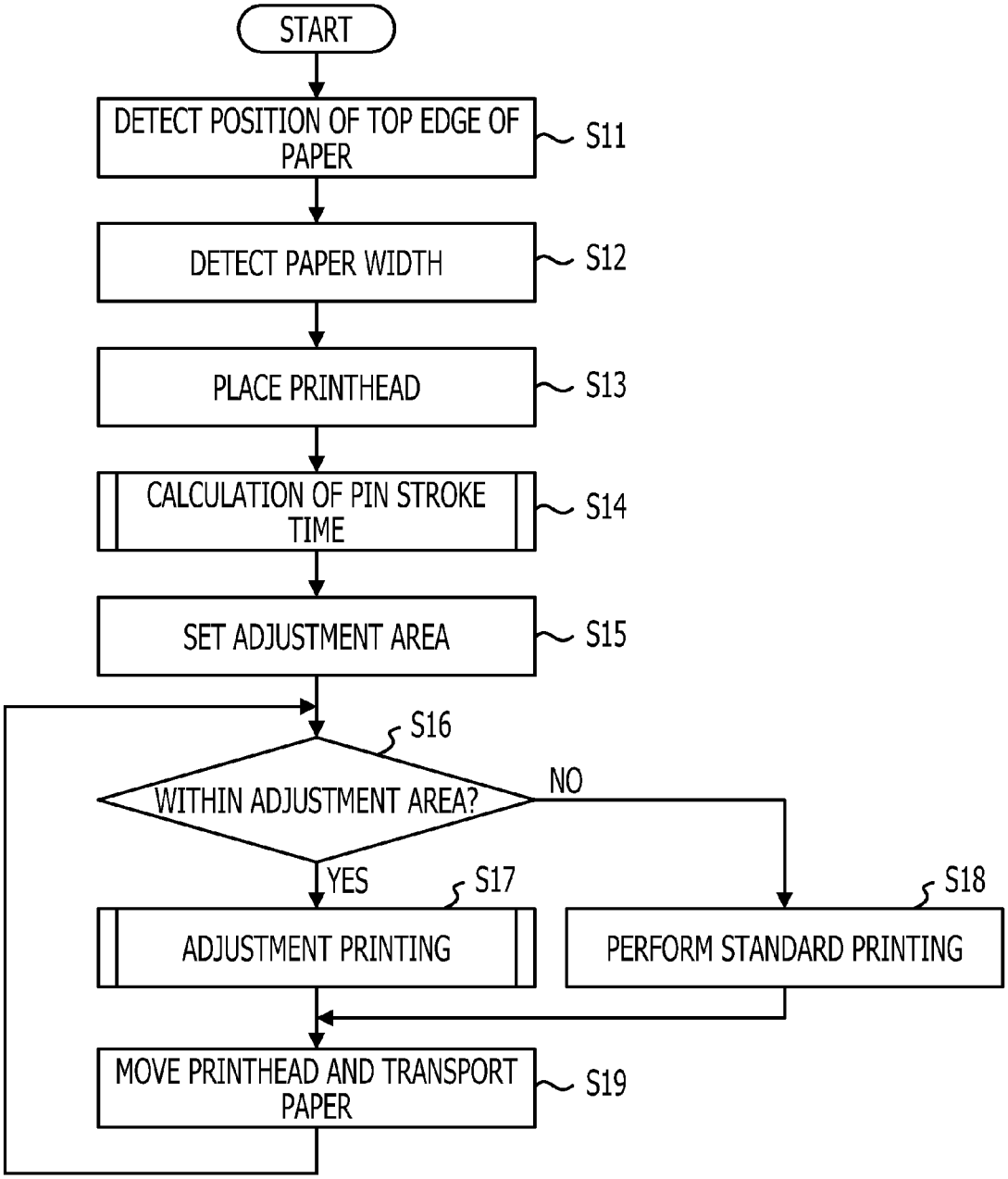
FIG. 17 is a flowchart illustrating an example of a printing control process.
Figure 18:
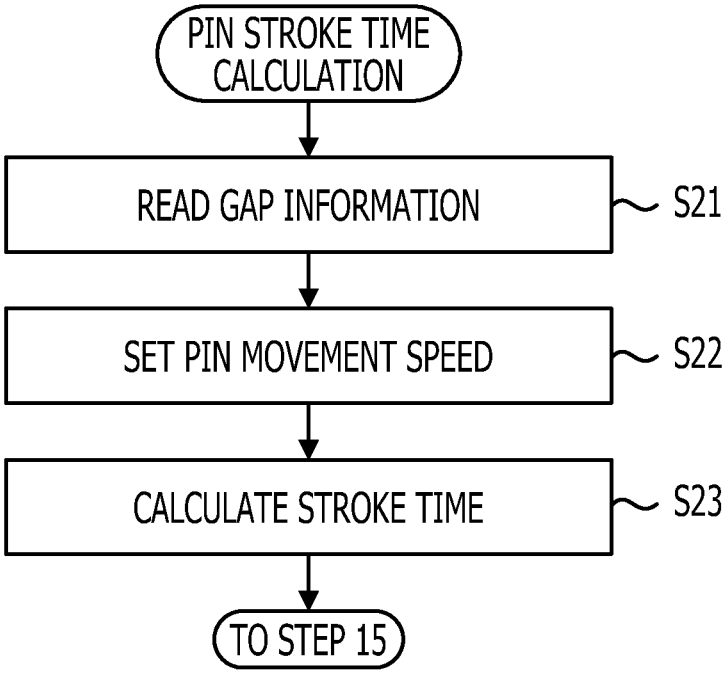
FIG. 18 is a flowchart illustrating an example of pin stroke time calculation.
Figure 19:
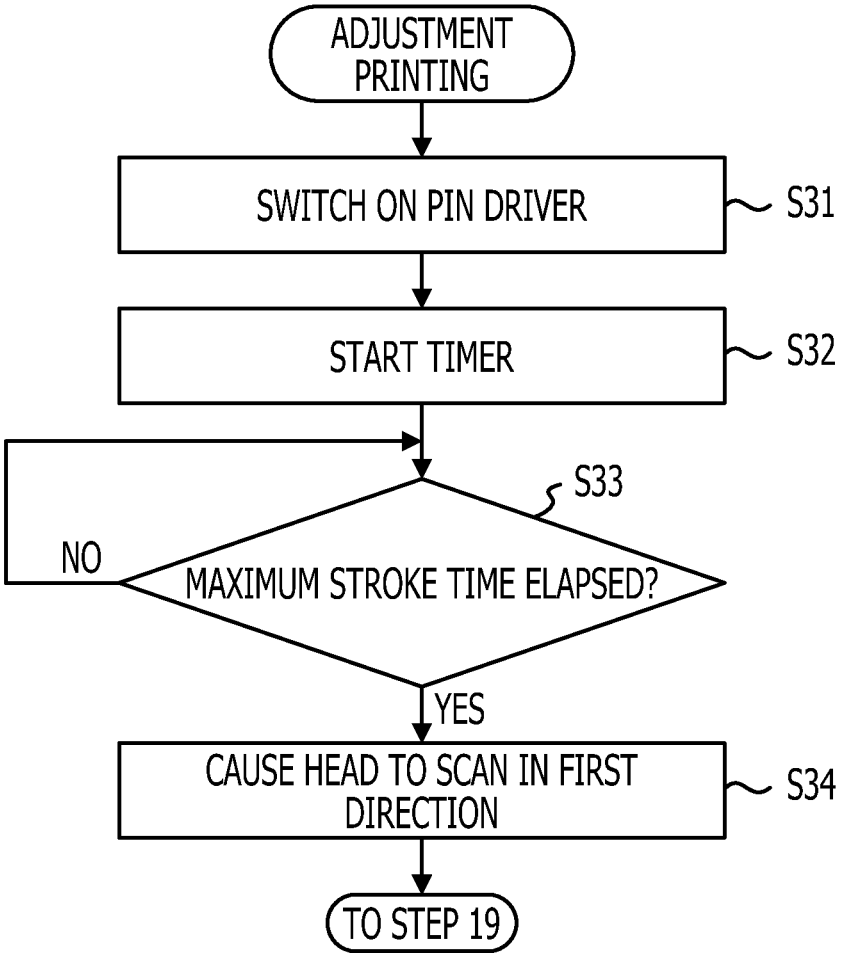
FIG. 19 is a flowchart illustrating an example of the adjustment printing process.

FIGS. 17 through 19 illustrate an example of the adjustment printing process. The adjustment printing process is an example of a process executed by the printing control program. The adjustment printing process includes a pre-printing process to set an adjustment area and a movement timing of the printhead 4 in the first scan direction within the adjustment area. The adjustment printing process also includes a printing process to print within the adjustment area and to print outside the adjustment area in standard printing.

The printer 20 detects the top edge position of the printing paper 24 when the printing paper 24 is set (S11). In the detection process, the paper sensor 88 and the paper width sensors 52 and 54 detects the presence or absence of the printing paper 24, and sets the reference position P for printing control (FIG. 11). The paper width sensors 52 and 54 also detect the paper width of the set printing paper 24 (S12). In the paper width detection, the paper width sensor 52 detects the left edge of the printing paper 24 and the paper width sensor 54 detects the right edge of the printing paper 24. The printer 20 thus sets a width in the first direction as a printing area of the printing paper 24. If the set printing paper 24 is colored or pr-printed as described above, the paper width sensor 54 is switched off. Only the left edge is detected and the reference position P is fixed.

The printhead 4 is placed at a print start position on the set printing paper 24 (S13). At the same time, the pin stroke time calculator 36 retrieves information of the paper thickness detected by the paper thickness sensor 56. The pin stroke time calculator 36 calculates the stroke time of the print pin from the retrieved paper thickness information (S14).

The printing adjustment unit 38 sets the adjustment area on the printing paper 24 in accordance with the information of the detected paper width (S15). In the setting of the adjustment area, adjustment area information set according to the type of the printing paper 24 and pre-stored on the storage 114 may be used. Alternatively, the setting information of the adjustment area input via the display and operation unit 86 may be used.

When the adjustment area is set, the printing process starts on the printing paper 24. The printer 20 determines whether the present position of the printhead 4 is within the adjustment area (S16). If the present position of the printhead 4 is within the adjustment area (yes from S16), the printer 20 enters the adjustment printing process (S17). If the present position of the printhead 4 is not within the adjustment area (no from S16), the printer 20 performs a standard printing process (S18). In the standard printing process, the printhead 4 moves in the first scan direction after retraction time that the head pins 22 has taken to be retracted traveling the gap h from the printing paper 24 or after elapse of a duration of time shorter than the refraction time.

When a standby time set in the adjustment printing process or the standard printing process has elapsed, the printer 20 moves the printhead 4 in the first scan direction or transports the printing paper 24 in the second scan direction (S19). Paper transport may be performed as a line-feed operation of the printing position when the printing of print data of one column is complete, or when the printhead 4 reaches the right edge of the printing paper 24.

In the pin stroke calculation process (S14) illustrated FIG. 18, the pin stroke time calculator 36 reads gap information including the paper thickness information (S21). The movement speed of raise and lower motions of the head pins 22 is set (S22). The movement speed of the head pins 22 may be set by referencing preset movement speed. The pin stroke time calculator 36 calculates the stroke time based on the gap information and the movement speed information of the head pins 22 (S23). The pin stroke time calculator 36 calculates the maximum stroke time with the head pins 22 projected by a maximum stroke. In the standard printing process, the pin stroke time calculator 36 also calculates the stroke time with the printhead 4 projected by the gap h.

In the adjustment printing process (S18) illustrated FIG. 19, the head pin driver 120 is switched on (S31), and the timer 104 starts time counting (S32). The head pin driver 120 may be started by driving an energizing switch to the electromagnetic solenoid 76.

The printing adjustment unit 38 keeps the printhead 4 waiting on standby until the maximum stroke time set has elapsed (no from S33). If the maximum stroke time set has elapsed (yes from S33), the printing adjustment unit 38 outputs a first scan instruction (S34).

The paper width may not detected, and the edge of the printing paper may remain unclear, or the punch hole may be formed in the printing paper. In such a case, the printer 20 described above controls the risk of damage of the head pin that could occur when the head pin is caught at the edge of the printing paper or the edge of the punch hole. Outside the adjustment area, the movement of the printhead is switched to the standard timing. Idle time in the printing process and the risk of damage of the head pin are both controlled. Performance of the printer 20 is increased.

Third Embodiment

Figure 20:
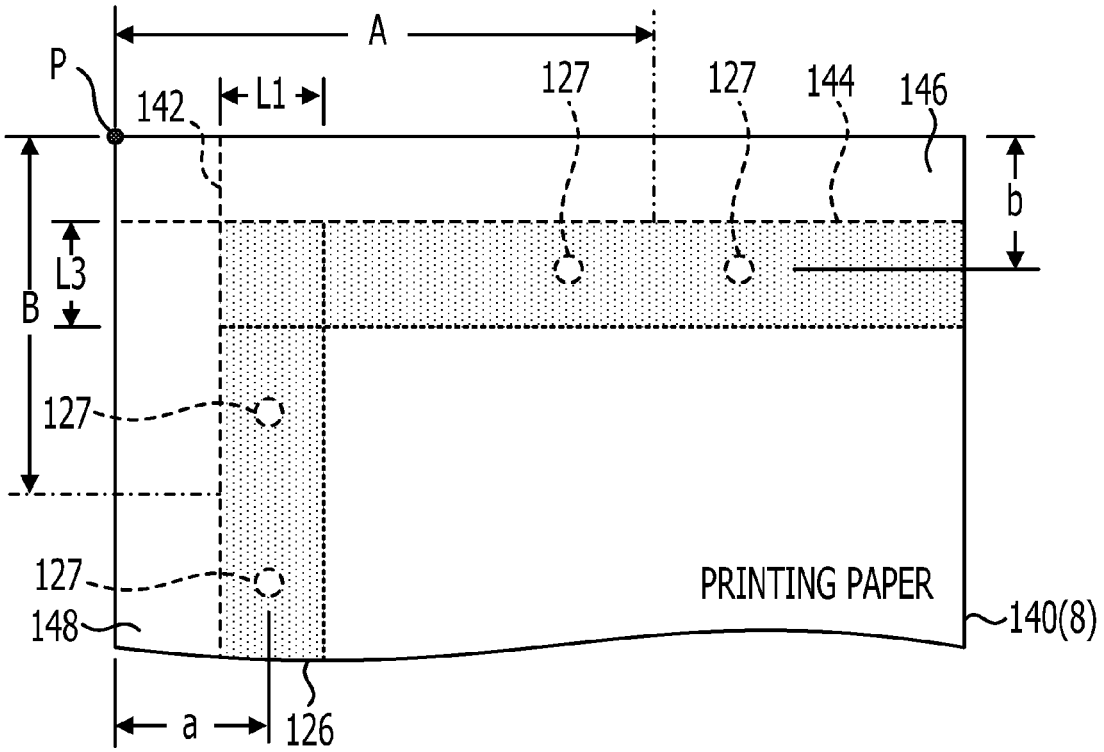
FIG. 20 illustrates an example of an adjustment area according to a third embodiment.
Figure 21:
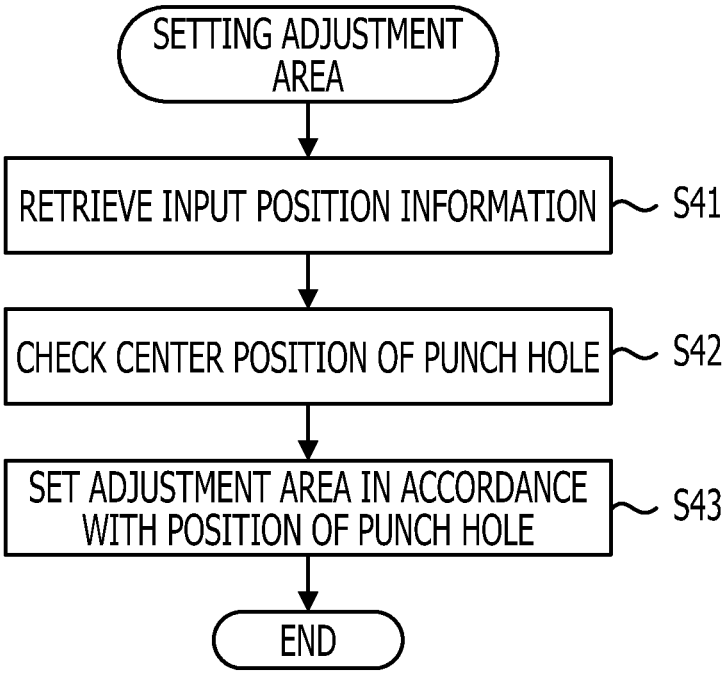
FIG. 21 is a flowchart illustrating an example of an adjustment area setting process.

FIGS. 20 and 21 illustrates the setting of an adjustment area in accordance with a third embodiment.

Printing paper 140 of FIG. 20 includes perforation lines 142 and 144 formed at specific positions spaced from the edges thereof. Portions of the printing paper 140 are thus detached along the perforation lines 142 and 144. Depending on the usage of the printing paper 140, a portion thereof is detached and the paper width thereof is modified. Since it is likely that margins 146 and 148 delineated by the perforation lines 142 and 144 are detached from the printing paper 140 subsequent to the printing process, the punch holes may be formed at a more inward location than in the printing paper 24. In the printing paper 140, the perforation lines 142 and 144 for detaching the margins become new paper edges. The punch holes are formed in areas delineated by specific lines spaced by specific distances L1 and L3 from the respective new paper edges.

The printing adjustment unit 38 retrieves width information of the margins 146 and 148 to be detached, and sets the adjustment area 126 on the printing paper 140 on the assumption that the margins 146 and 148 have been detached.

In one example of the setting of the adjustment area 126, center lines passing through the center of the printing paper 140 with the margins 146 and 148 detached are assumed. A center position between the formed punch holes 127 is then verified. Distances A and B are then determined from the reference position P of the printing paper 140 before the margins 146 and 148 are detached.

The printing adjustment unit 38 calculates each of distances a and b by summing the distance between the center of the punch holes 127 and the edges of the printing paper 140 without the margins 146 and 148 and the width of the margins 146 and 148. The printing adjustment unit 38 sets the widths L1 and L3 of the adjustment area so that lines defined by the calculated distances a and b of the punch holes 127 are included in the widths L1 and L3. The adjustment area 126 may be determined in view of the distances A and B between the neighboring punch holes 127.

FIG. 21 illustrates a setting process of the adjustment area.

The printing adjustment unit 38 retrieves position information input about the margins 146 and 148 of the printing paper 140 or position information stored on the memory about the margins 146 and 148 of the printing paper 140 (S41). The printing adjustment unit 38 verifies the center positions of the punch holes 127 by referencing the position information of the punch holes 127 input or stored on the memory together with the position information of the margins 146 and 148 (S42). The distances A, B, a and b are also calculated in that process.

In accordance with those pieces of position information, the printing adjustment unit 38 sets the adjustment area 126 of the printing paper 140 defined by the specific distances L1 and L3 with the margins 146 and 148 detached (S43).

In the printing process, the adjustment printing is performed on the set adjustment area 126.

As with the preceding embodiments, the printer of the third embodiment controls the risk of damage of the head pin that could occur where the punch holes are likely formed or at the edge of the printing paper.

The features of the first, second, and third embodiments are described below.

(1) The printers of the first, second, and third embodiments have a damage control function of the head pin of the printhead.

(2) The printers 2 and 20 calculate the maximum pin stroke time as waiting time of the printhead 4 after the paper feeder unit 82 feeds the printing paper 24 and the printing paper 140. The printers 2 and 20 set the adjustment area where the edge and the punch hole of the printing paper set according to the paper width detected by the paper width sensors 52 and 54 are assumed to be present. The printing adjustment unit 38 suspends the movement of the printhead 4 in the adjustment area in the first direction in accordance with the maximum pin stroke time until the head pins 22 are retracted in the printhead 4. Even if the printing process is performed at the edge or the punch hole of the printing paper, the damage to the head pins 22 is controlled.

(3) The printers 2 and 20 may print on a pre-printed paper sheet with the paper width sensor 54 switched off to control an erratic detection of recognizing a pre-printed portion for the edge portion of the paper. Even in such a case, the head pins 22 are free from being caught by the paper edge or the punch hole. The risk of damage to the head pins 22 is controlled even if the printing paper has characters and color pre-printed thereon.

(4) The printing control process is based on the assumption that a maximum difference occurs between the pin stroke time in the printing on the printing paper and the pin stroke time in the printing in the punch hole outside the printing paper. In the adjustment area, the printhead 4 remains stationary until the maximum stroke time has elapsed.

(5) The adjustment area is not limited to the upper edge portion or the left edge portion of the printing paper. The adjustment area may be set to the right edge portion or the bottom edge portion of the printing paper 24. In the setting of the adjustment area on the bottom edge portion of the printing paper 24, the paper sensor 88 mounted on the printer may be used during paper transportation, and the adjustment area may be set to an area extending upward by 20 mm from the detected bottom edge of the printing paper 24.

(6) The punch holes 127 on the top portion of the printing paper 24 are arranged with respect to the center line of the printing paper 24 with space of 80 mm permitted therebetween. The punch holes 127 are centered at a line extending along and spaced from the top edge of the printing paper 24 by 13 mm and have a diameter of 6 mm. The punch holes 127 are formed within an area of 16 mm width from the top edge of the printing paper 24. The overall length of the contact face of the printhead 4 to the printing paper 24 is 3.4 mm, for example. The adjustment area 126 is set within an area extending downward from the top edge of the printing paper 24 by 20 mm including margins. The punch holes 127 on the left edge portion of the printing paper 24 are arranged with respect to the center line of the printing paper 24 with space of 80 mm permitted therebetween. The punch holes 127 are centered at a line extending along and spaced from the left edge of the printing paper 24 by 13 mm and have a diameter of 6 mm. The punch holes 127 are also centered at a line spaced from the side edge of the printing paper 24 by 16 mm. The adjustment area 126 is set within an area extending rightward from the ledge edge of the printing paper 24 by 20 mm. If the printing paper 24 is inserted in an upside down fashion or a left side right fashion, the adjustment area may be similarly set on the bottom edge portion and the right edge portion of the printing paper 24.

(7) A perforation line may be formed on the printing paper 140 to modify the paper size thereof. For example, the printing paper 140 may be expanded or reduced in size by means of the perforation line. The adjustment area 126 is set in accordance with the input punch hole. For example, the adjustment area 126 may be set on the printing paper 140 of FIG. 20 in accordance with the calculated distances A and b, or a and B.

Fourth Embodiment

FIGS. 22 through 24A and 24B illustrate a printer 160 of a fourth embodiment that detects a paper edge. The elements of FIGS. 22 through 24A and 24B are illustrated for exemplary purposes only, and the fourth embodiment is not limited to those illustrated herein.

Figure 22:
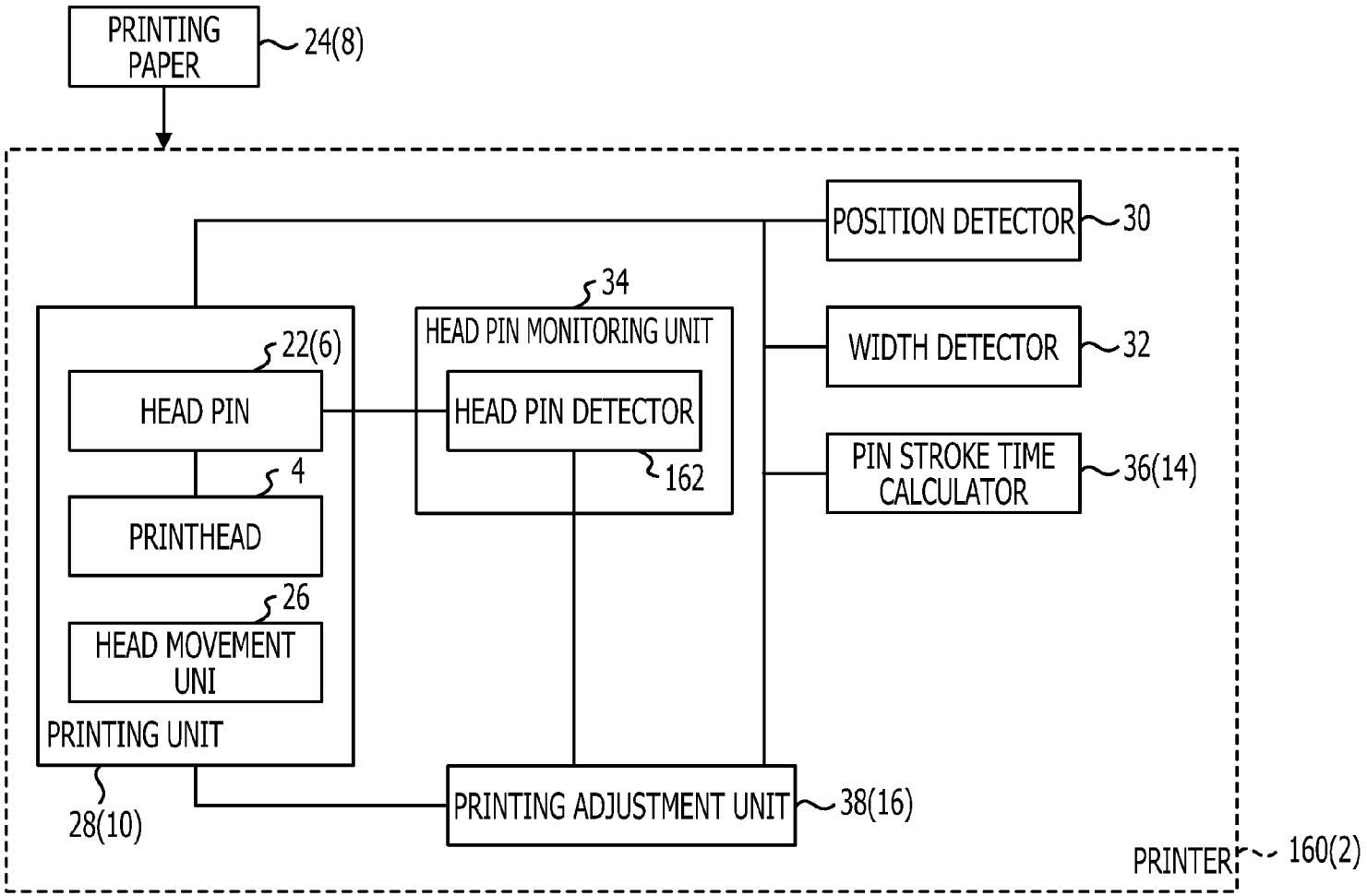
FIG. 22 illustrates a printer of a fourth embodiment.

The printer 160 of FIG. 22 modifies a movement timing of the printhead 4 in the set adjustment area, and performs the adjustment printing process in which the printhead 4 is kept on standby until the maximum pin stroke time has elapsed. In the adjustment printing process, the printer 160 monitors the lower motion of the head pins 22. The printer 160 thus determines whether the position of the lowered head pins 22 is at the edge of the printing paper 24 or in the punch hole.

The printer 160 includes a head pin detector 162 in the head pin monitoring unit 34. The head pin detector 162 includes the pin sensor 78 (FIG. 5) that monitors the lowered state of the head pins 22. In response to the results of the monitoring of the head pins 22, the head pin detector 162 determines whether the printhead 4 has reached the edge of the printing paper 24.

As described above, the pin sensor 78 detects the contact state thereof with the arm portion 70 of the head pins 22. When the head pins 22 are retracted in the printhead 4, the pin sensor 78 is electrically connected to the arm portion 70. When the head pins 22 are lowered, the arm portion 70 is out of touch with the pin sensor 78. When the head pins 22 are raised, the arm portion 70 is in touch with the pin sensor 78.

Upon detecting the non-contact state of the pin sensor 78 with the head pins 22 lowered, the head pin monitoring unit 34 starts time counting the stroke time with the timer 104. The timer 104 continues time counting until the head pin monitoring unit 34 detects the next contact state of the pin sensor 78.

If the counted stroke time matches the pre-calculated maximum stroke time, the head pin detector 162 determines that the head pins 22 have been lowered to a location other than the printing paper 24. The detection process of the paper edge is thus performed.

The lowered state of the head pins 22 may be determined by comparing the counted stroke time with the stroke time taken by the head pins 22 that are lowered onto the printing paper 24.

If the printing position of the head pins 22 is outside the printing paper 24, the head pin monitoring unit 34 issues a paper error notification. If a data length set in the print data is larger than a paper width of the printing paper 24, the printing adjustment unit 38 deletes print data corresponding to an extra portion outside the printing paper 24.

Figure 23A:
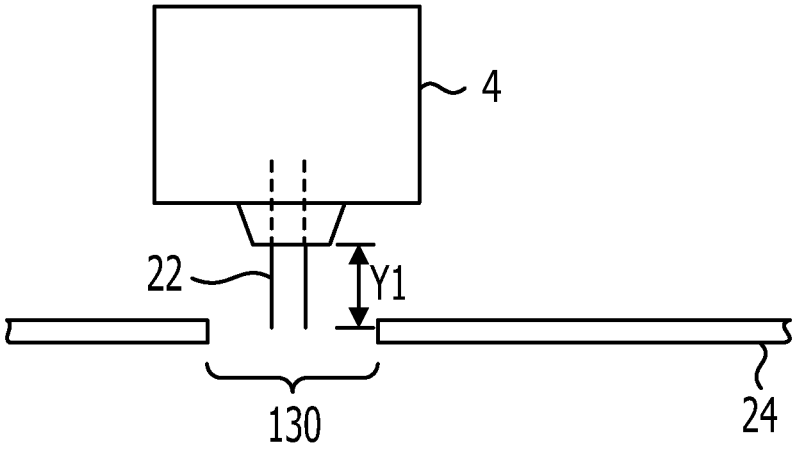
FIGS. 23A and 23B illustrate the principle of a paper edge detection process.

The head pins 22, when lowered into the punch hole 130 as illustrated in FIG. 23A, has a maximum value Y1 of the stroke distance. The head pin monitoring unit 34 monitors a period of time with the pin sensor 78 until the head pins 22 are retracted in the printhead 4. The head pin monitoring unit 34 thus determines whether the head pins 22 have been lowered onto a location other than the printing paper 24. If the head pin monitoring unit 34 determines that the head pins 22 have been lowered onto a location other than the printing paper 24, the printer 160 enters the detection process of the edge of the printing paper.

Figure 23B:
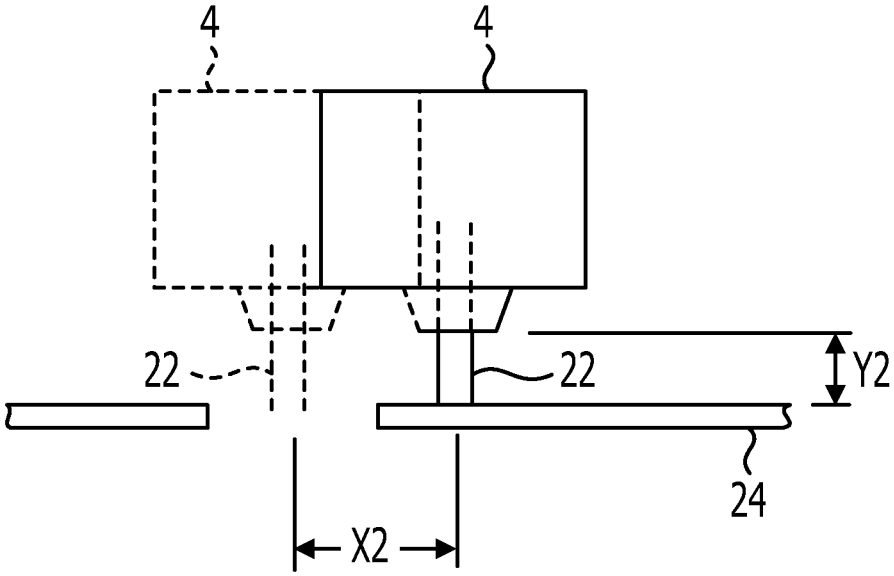

In the detection process of FIG. 23B, the printhead 4 is moved in the first scan direction by a specific distance X2. The specific distance X2 may be any value set for the detection process of the edge of the printing paper, or may be a first scan amount corresponding to one standard character. The head pins 22 are lowered, and the head pin detector 162 monitors the stroke time. Since the head pins 22 are lowered onto the printing paper 24 as illustrated in FIG. 23B, the stroke time is shorter than the maximum stroke time. The head pin monitoring unit 34 determines that the printhead 4 has not yet reached the edge of the printing paper 24, and the printing process continues.

Figure 24A:
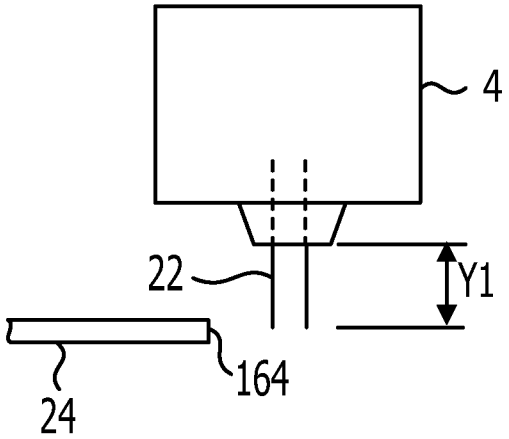
FIGS. 24A and 24B illustrate the principle of the paper edge detection process.
Figure 24B:
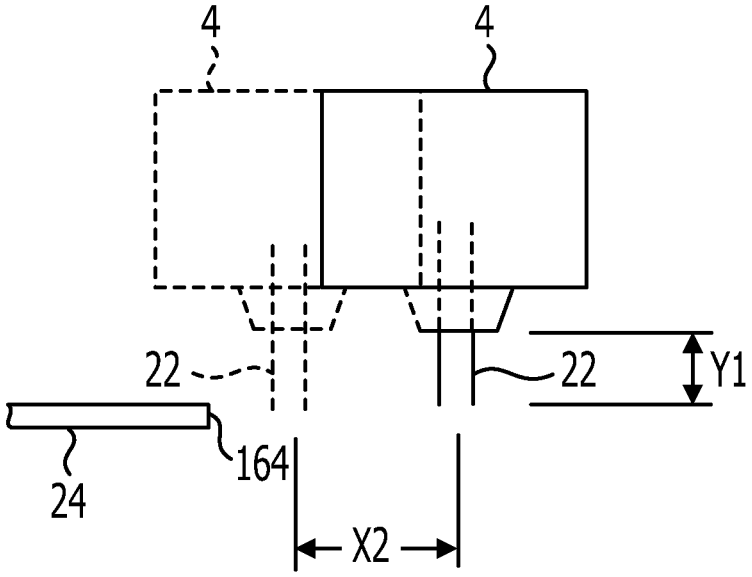

As illustrated in FIG. 24A, the printing process is performed with the printhead 4 off the paper edge 164 of the printing paper 24. The head pin detector 162 also monitors the stroke time. In the detection process of FIG. 24B, the head pins 22 are lowered onto a location outside the printing paper 24, and the stroke distance becomes a maximum value Y1. Upon detecting that the stroke time is the maximum stroke time, the head pin detector 162 determines that the printhead 4 has reached the edge 164. In the paper edge detection, the head pin detector 162 monitors the stroke time again with the printhead 4 moved by the specific distance X2 in the first scan direction. The head pin detector 162 thus detects that the head pins 22 are lowered onto an area extending wider than the diameter of the punch hole 130.

Figure 25:
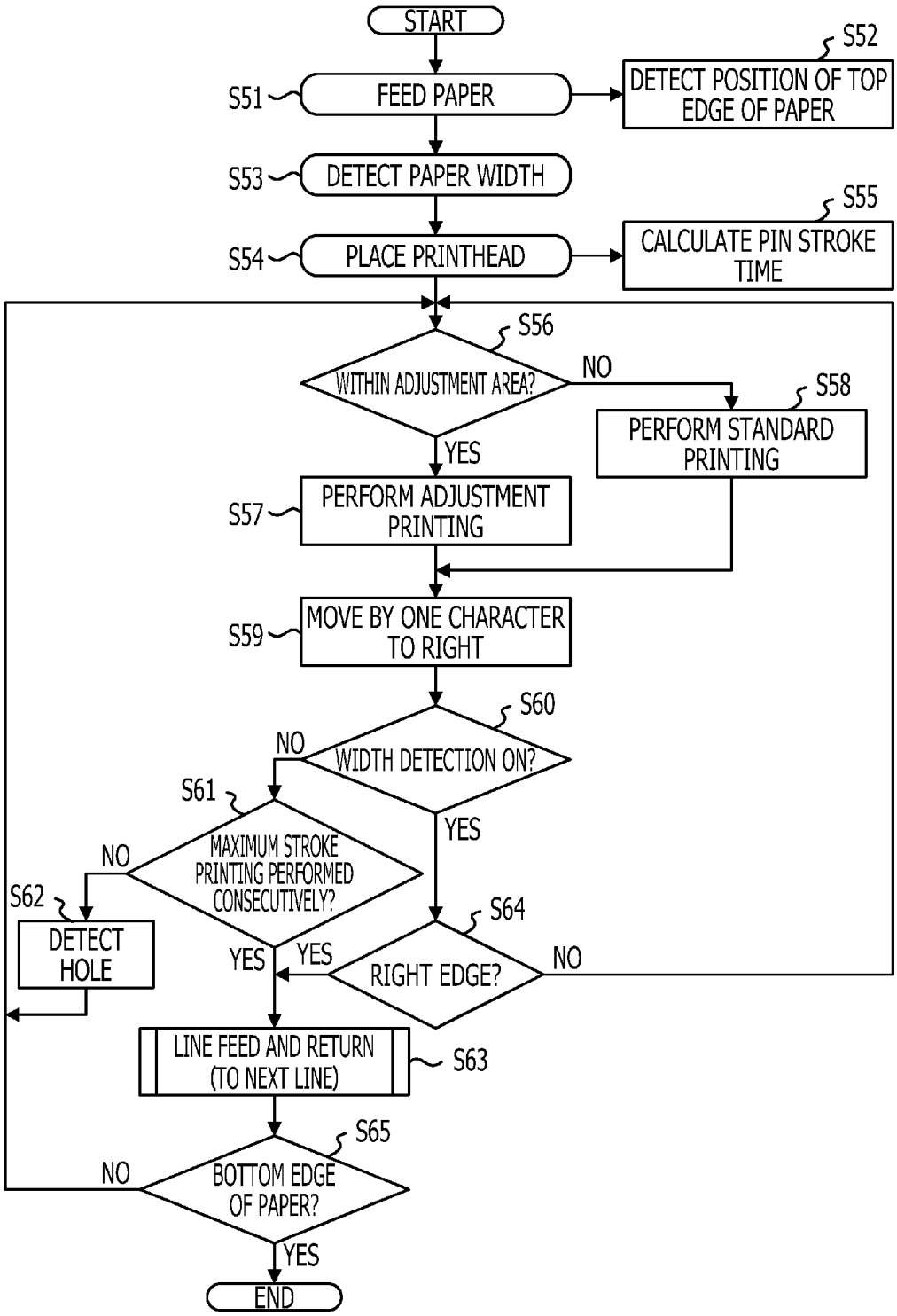
FIG. 25 is a flowchart illustrating an example of a printing control process.
Figure 26:
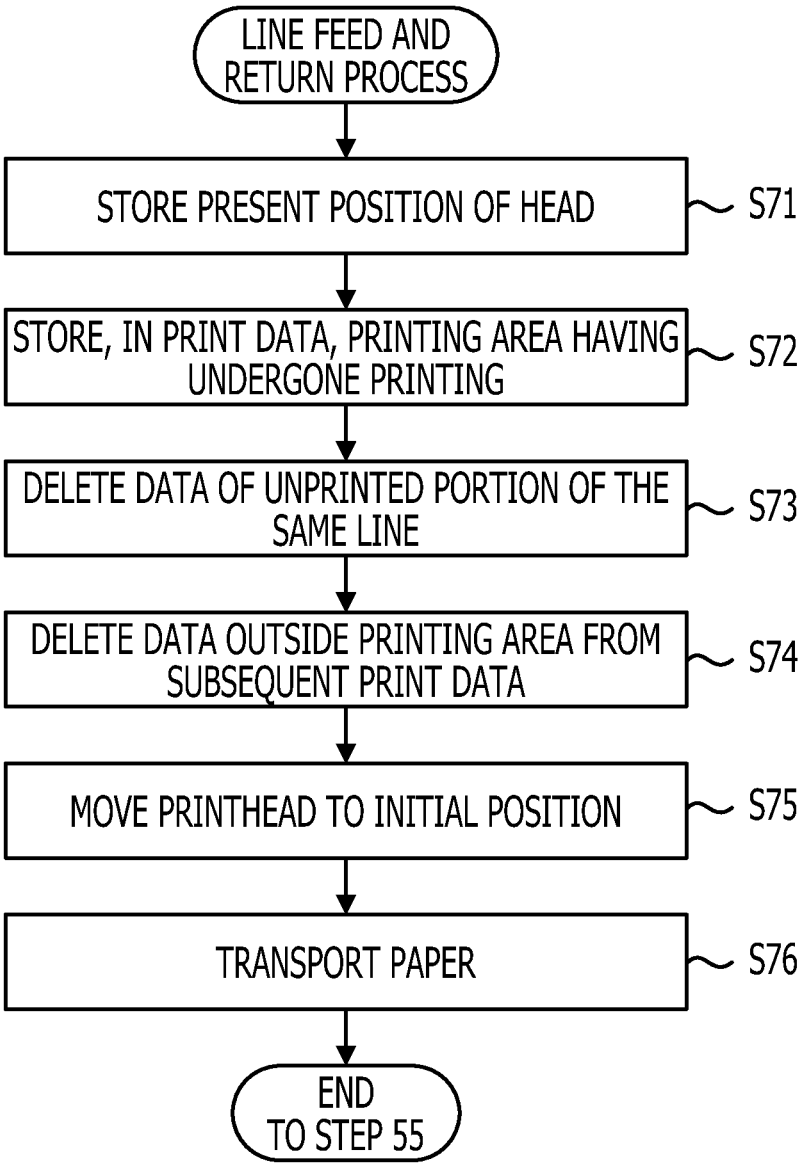
FIG. 26 is a flowchart illustrating an example of the printing control process performed with the paper edge detected.

FIGS. 25 and 26 illustrate the adjustment printing process including the paper edge detection. The content and procedure of the process of FIGS. 25 and 26 are illustrated for exemplary purposes only, and the embodiments are not limited to those described herein.

The adjustment printing process including the paper edge detection includes setting the adjustment area setting process, calculating the pin stroke time based on the paper thickness information, and monitoring the stroke time of the lowered head pins 22 to determine whether the printhead 4 is at the paper edge.

The printing paper is fed into the printer 20 (S51). The printer 160 performs a paper top edge detection operation (S52), a width detection operation including the setting of the adjustment area (S53), a placement operation of the printhead 4 (S54), and a calculation operation of the pin stroke time (S55). If the printhead 4 is within the set adjustment area (yes from S56), the printing adjustment unit 38 performs the adjustment printing process (S57). If the printhead 4 is not within the set adjustment area (no from S56), the standard printing process is performed (S58). When the head pins 22 performs the printing process, the printhead 4 is moved rightward by one character in the first scan direction (S59). Operations in S51 through S59 may be performed in the same manner as in steps S11 through S19, and the detailed discussion thereof is omitted herein.

The printer 160 determines whether the paper width sensor 54 detecting the right edge of the printing paper 24 is on (S60). If the paper width sensor 54 is not on (no from S60), the printer 160 determines whether maximum stroke printing is consecutively performed (S61). The determination operation of the maximum stroke printing is intended to detect the paper edge, and is performed by monitoring the stroke time of the lowered head pins. If the maximum stroke time is monitored, the printhead 4 is moved by the specific distance X2. The head pins 22 are then lowered again. If the maximum stroke time is monitored again, the head pin detector 162 determines that the maximum stroke printing has been performed consecutively.

If the maximum stroke printing has not been performed consecutively (no from S61), the printer 160 determines that the head pins 22 have been lowered into the punch hole 130 (S62). Processing returns to step S56 to perform the printing process. If the maximum stroke printing has been performed consecutively (yes from S61), the printer 160 determines that the printhead 4 has reached the paper edge 164, and performs line feed and carriage return (S63).

If the paper width sensor 54 is on (yes from S60), and if the right edge of the printing paper 24 has been detected (yes from S64), processing proceeds to step S63. If the right edge has not been detected (no from S64), processing returns to step S56 to perform the printing process.

If the printer 160 determines that the printhead 4 is at the bottom edge of the printing paper 24 (yes from S65) subsequent to the line feed and carriage return, the printing process ends. If the printhead 4 is not at the bottom edge (no from S65), process returns to step S56 to perform the next printing process.

If the bottom edge of the printing paper 24 has been detected, the line feed and carriage return process is performed as illustrated in FIG. 26. The printing adjustment unit 38 may execute the line feed and carriage return process.

In the line feed and carriage return process, the printhead 4 is moved to a print start position and the printing paper 24 is transported in the second scan direction. If the length of the print data read into the printer 160 is longer than the paper width, data of an unprinted portion of the present print line are deleted.

The printer 160 stores the present position of the printhead 4 from which the maximum stroke length has been consecutively detected (S71). The printing adjustment unit 38 references the print data read into the printer 160 and the present position of the printhead 4, and then stores an area having undergone the printing process as a printing area into the print data (S72). As opposed to the printing area, data of unprinted data on the same line as the line of print data received from a host personal computer or the like are deleted as nonprinting area data (S73).

The printing adjustment unit 38 deletes non-printing area data set on a line subsequent to the printed portion, from the data length of the print data transmitted from the host personal computer (S74). More specifically, on the next lines thereafter, the printing adjustment unit 38 sets such that the printer 160 performs the printing process to characters of the same character count within the stored printing area.

The unprinted print data are deleted, and the printhead 4 moves to the initial position thereof (S75). The paper transport unit 122 operates and transports the printing paper 24 in the second scan direction (S76). The line feed and carriage return process ends, and processing returns to step S65.

If the unprinted data remain in step S73, the printing paper 24 set in the printer 160 fails to match the length of the print data, and an error indication may be displayed on the display unit 124. An error notification may be transmitted to an electronic apparatus such as a personal computer connected to the printer 160.

The printer 160 of the fourth embodiment performs the printing process in response to the printing paper set in the printer 160. The printer 160 of the fourth embodiment controls the lowering of the head pins 22 on a location other than the printing area. The head pin damage control function is enhanced.

The fourth embodiment has the following features.

(1) The printer 160 may print on a printing paper sheet pre-printed with a dense color with the paper width sensor 54 set to be off. In such a case, The printer 160 reduces the number of lowering motions of the head pins 22 to a location outside the printing area of the printing paper 24. If a printing paper sheet having a width narrower than the print data length set for the same one line is used, the printer 160 causes the head pins 22 not to strike beyond the printing paper width.

(2) If the detected pin stroke time of the head pins 22 is the maximum pin stroke time in the printing control, it is likely that the head pins 22 print outside the printing area. The head pins 22 are lowered to a location outside the printing area if printing is performed in the punch hole 130 or beyond the printing paper edge 164. The diameter of the punch hole 130 is 6 mm, for example. The printhead 4 is then moved by 6 mm, and then the head pins 22 are then lowered again. If the maximum stroke time is consecutively monitored, it is determined that the printhead 4 has reached the right edge of the printing paper 24. This determination operation may be performed on the first line of the printing paper 24. If the right edge of the printing paper 24 is detected, print data beyond the width of the printing paper are deleted in the printing process.

The printers and the printing control program described herein may provide the following features.

(1) A specific area where the edge of a printing medium is present or the punch hole is formed is set as the adjustment printing area, and the scan timing of the printhead in the first scan direction is modified accordingly. The risk of damage to the head pins 22 in the printing in the punch hole is thus controlled. Reliability of the printer is enhanced.

(2) The scan timing of the printhead in the first scan direction is delayed within the adjustment printing area. Even if a paper sheet presenting difficulty in the detection of a paper width is used, the risk of damage to the head pins 22 is controlled.

(3) The scan timing of the printhead in the first scan direction is modified using the maximum stroke time of the head pins. The simple structure controls the risk of damage to the head pins regardless of the number of sheets or the thickness of the sheet.

The preferable embodiments of the printer and the printing control program have been discussed. The embodiments are not limited to those discussed above.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A printer comprising:

a memory that memorizes a value of a maximum stroke; and a processor that executes a process, the process comprising calculating a maximum stroke time that lasts from when a print pin arranged in a printhead is projected from the printhead by the maximum stroke to when the print pin is retracted in the printhead;

setting an adjustment printing area on the printing medium; and switching a movement timing of the printhead in accordance with the maximum stroke time when a printing position of the printhead falls within the adjustment printing area set on the printing medium.

2. A printer comprising:

a printhead that moves over a printing medium and includes a print pin arranged such that the print pin is allowed to be projected from the printhead, and;

a print pin monitor that monitors a projection state of the print pin from the printhead;

a maximum stroke time calculator that calculates in accordance with monitoring results of the print pin monitor a maximum stroke time that lasts from when the print pin is projected from the printhead by a maximum stroke to when the print pin is retracted in the printhead; and a controller that switches a movement timing of the printhead in accordance with the maximum stroke time when a printing position of the printhead over the printing medium falls within an adjustment printing area set on the printing medium.

3. The printer according to claim 2, wherein the controller suspends a movement of the printhead until the print pin is retracted in the printhead when the printing position of the printhead over the printing medium falls within the adjustment printing area.

4. The printer according to claim 2, wherein the print pin monitor comprises:

a sensor that detects whether the print pin is retracted in the printhead; and a timer that measures a stroke time that lasts from when the print pin is projected from the printhead to when the print pin is retracted in the printhead.

5. The printer according to claim 4, wherein the controller sets as a printable area an area extending to a printing position immediately before the stroke time becomes the maximum stroke time when the stroke time becomes the maximum stroke time a plurality of times consecutively.

6. The printer according to claim 5, wherein the controller deletes print data beyond the printable area, moves the printhead to the print start position and transport the printing medium when the printhead reaches the printable area.

7. The printer according to claim 4, the printer further comprising a notification unit that gives a notification when the stroke time becomes the maximum stroke time.

8. The printer according to claim 2, the printer further comprising a printing medium position detection sensor that detects a print start position of the printing medium and at least one of the top edge, the left edge, the right edge and the bottom edge of the printing medium, wherein the controller sets the adjustment printing area in accordance with detection results of the printing medium position detection sensor.

9. The printer according to claim 2, wherein the adjustment printing area is set to be a specific area that extends from at least one of the positions of the leading edge, the trailing edge, the left edge and the right edge of the printing medium and covers an area where the print pin is unable to print.

10. The printer according to claim 2, wherein the printing medium comprises at least one of a printing paper sheet, a perforated paper sheet and a perforation-lined paper sheet.

11. A computer readable storage medium storing a program that controls a printer for printing on a printing medium, the program causing the printer to perform a process, the process comprising:

calculating a maximum stroke time that lasts from when a print pin arranged in a printhead is projected from the printhead by a maximum stroke to when the print pin is retracted in the printhead;

setting an adjustment printing area on the printing medium; and switching a movement timing of the printhead in accordance with the maximum stroke time when a printing position of the printhead falls within the adjustment printing area set on the printing medium.

12. The computer readable medium according to claim 11, wherein the process further comprises suspending a movement of the printhead until the print pin is retracted in the printhead when the printing position of the printhead falls within the adjustment printing area.

13. The computer readable medium according to claim 11, wherein the process further comprises:

measuring a stroke time that lasts from when the print pin is projected from the printhead by the maximum stroke to when the print pin is retracted in the printhead;

setting as a printable area an area extending to a printing position immediately before the stroke time becomes the maximum stroke time when the stroke time becomes the maximum stroke time a plurality of times consecutively; and printing to the printable area.

14. The computer readable medium according to claim 11, wherein the process further comprises deleting print data beyond the printable area, moving the printhead to a print start position and transporting the printing medium when the printhead reaches the printable area.

* * * * *